US009533693B2

(12) United States Patent
Hjort et al.

(10) Patent No.: US 9,533,693 B2
(45) Date of Patent: Jan. 3, 2017

(54) GANGWAY FLOOR FOR A GANGWAY BETWEEN A FIRST CAR OF A MULTI-CAR VEHICLE AND A SECOND CAR OF SAID VEHICLE

(71) Applicant: DELLNER COUPLERS AB, Falun (SE)

(72) Inventors: Mathias Hjort, Hedemora (SE); Roger Danielsson, Krylbo (SE); Fredrik Hedh, Avesta (SE); Tommy Fälth, Hedemora (SE)

(73) Assignee: Ego International B.V., Eindhoven (NL)

( * ) Notice: Subject to any disclaimer, the term of this patent is extended or adjusted under 35 U.S.C. 154(b) by 278 days.

(21) Appl. No.: 14/365,447

(22) PCT Filed: Dec. 13, 2012

(86) PCT No.: PCT/EP2012/005144

§ 371 (c)(1),
(2) Date: Jun. 13, 2014

(87) PCT Pub. No.: WO2013/087206

PCT Pub. Date: Jun. 20, 2013

(65) Prior Publication Data

US 2015/0000550 A1 Jan. 1, 2015

(30) Foreign Application Priority Data

Dec. 13, 2011 (EP) ..... 11009818
Jan. 20, 2012 (EP) ..... 12000360
(Continued)

(51) Int. Cl.
*B61D 17/20* (2006.01)
*B61D 17/22* (2006.01)
(Continued)

(52) U.S. Cl.
CPC ..... *B61D 17/20* (2013.01); *B61D 17/22* (2013.01); *B61F 5/50* (2013.01); *B61F 1/12* (2013.01); *B61G 7/10* (2013.01)

(58) Field of Classification Search
CPC ..... B61D 17/20; B61D 17/22; B61D 3/187; B61F 1/12; B61G 5/00; B61G 7/10
(Continued)

(56) References Cited

U.S. PATENT DOCUMENTS 1,501,325 A 7/1924 Elliott
4,455,033 A * 6/1984 Becker ..... B61D 17/20 105/17
(Continued)

FOREIGN PATENT DOCUMENTS

DE 711714 C 10/1941
DE 2318369 A1 10/1974
(Continued)

OTHER PUBLICATIONS

International Search Report dated Apr. 8, 2013 for related PCT application No. PCT/EP2012/005144.

*Primary Examiner* — Zachary Kuhfuss
(74) *Attorney, Agent, or Firm* — Howard IP Law Group, P.C.

(57) ABSTRACT

A gangway floor for a gangway between a first car of a multi-car vehicle and a second car of said vehicle comprises a first floor panel and a second floor panel, wherein the first floor panel is arranged to rotate about a first axis that does not lie in the plane that the first floor panel lies in, and the second floor panel is arranged to rotate about a second axis that does not lie in the plane that the second floor panel lies in, wherein the first axis is different from the second axis.

20 Claims, 19 Drawing Sheets

(30) Foreign Application Priority Data

Figure 1:
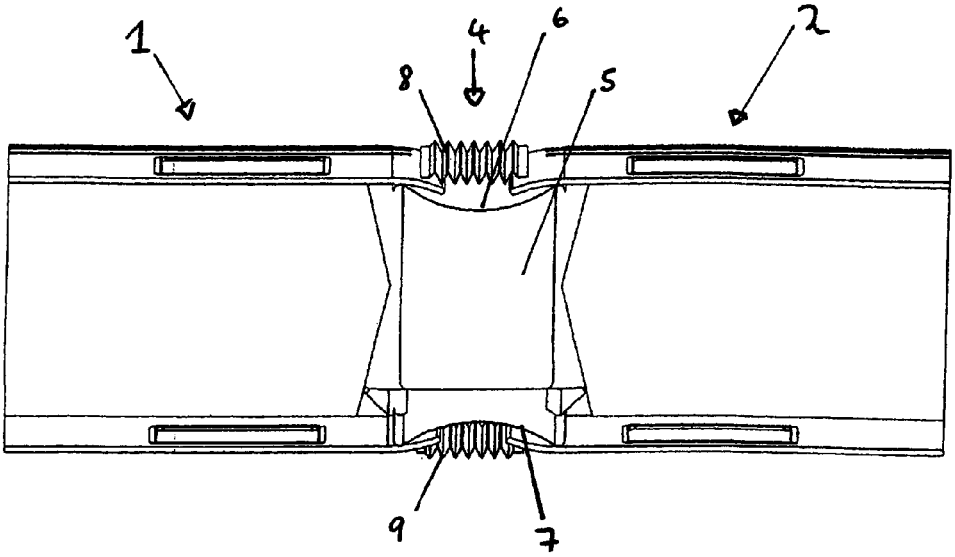

| | | |
|---|---|---|
| May 29, 2012 | (EP) | 12004117 |
| Aug. 21, 2012 | (EP) | 12005978 |
| Aug. 21, 2012 | (EP) | 12005979 |
| Sep. 18, 2012 | (EP) | 12006533 |
| Sep. 18, 2012 | (EP) | 12006535 |

(51) Int. Cl.
*B61F 5/50* (2006.01)
*B61F 1/12* (2006.01)
*B61G 7/10* (2006.01)

(58) Field of Classification Search
USPC ..... 105/8.1, 10, 15
See application file for complete search history.

(56) References Cited

U.S. PATENT DOCUMENTS 4,458,911 A * 7/1984 Chadwick ..... B61D 17/20 105/17
4,503,779 A * 3/1985 Chadwick ..... B61D 3/12 105/17
4,579,063 A * 4/1986 Losa ..... B61D 17/20 105/4.4
4,781,123 A * 11/1988 Yoshihara ..... B61F 5/16 105/3
4,869,178 A * 9/1989 Bechu ..... B60D 5/006 105/15
4,903,612 A * 2/1990 Sassa ..... B61D 17/20 105/18
2006/0107865 A1* 5/2006 Kobayashi ..... B61D 17/20 105/460
2011/0272915 A1* 11/2011 Browne ..... B60D 1/62 280/403

FOREIGN PATENT DOCUMENTS

EP 0129772 A2 1/1985
FR 2798889 A1 3/2001

* cited by examiner

Fig. 5
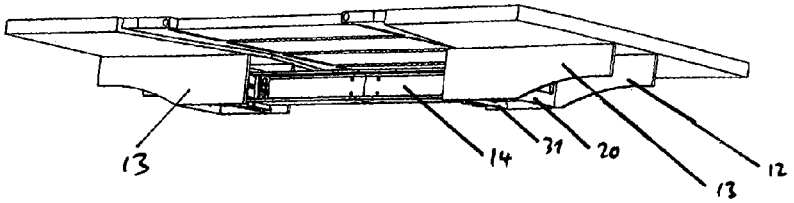
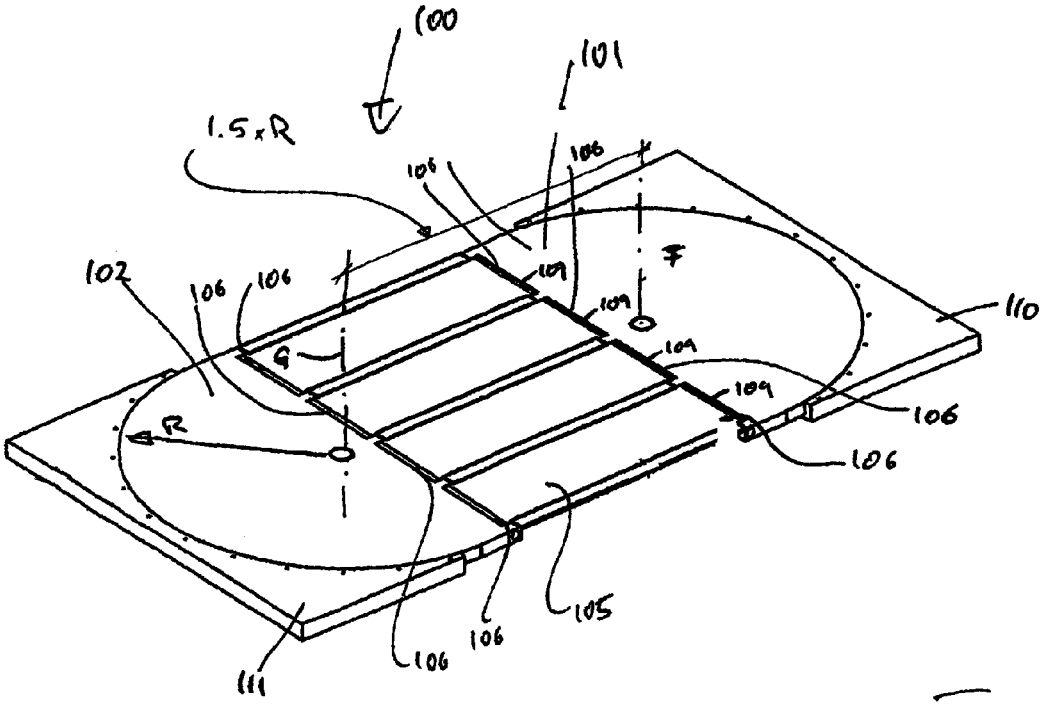
Fig. 6

Fig. 13
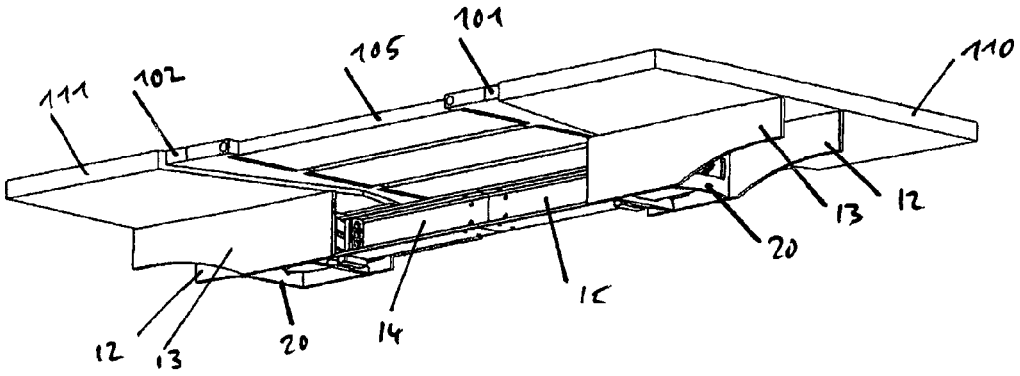
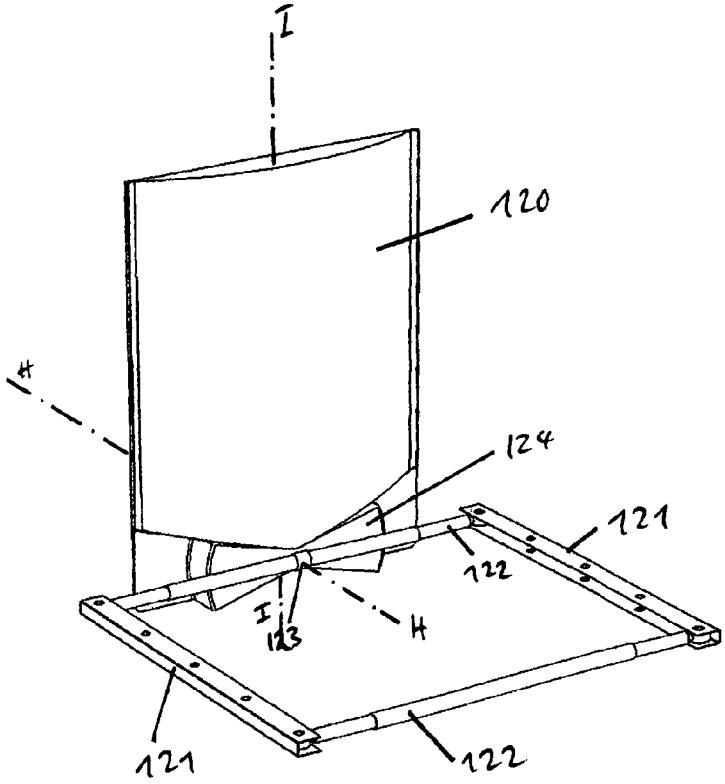
Fig. 14

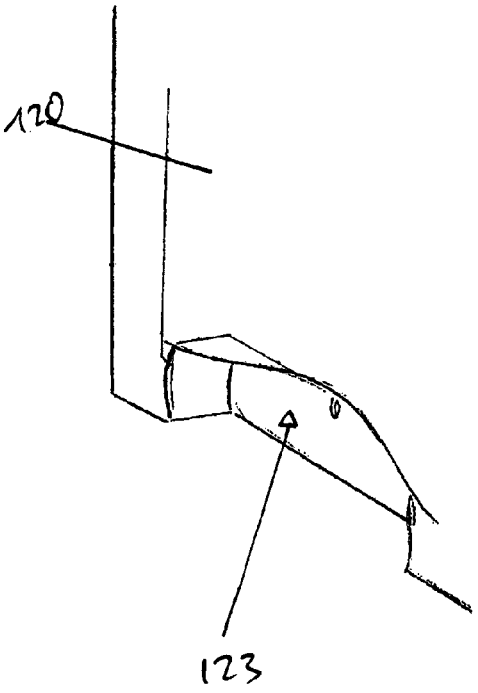
Fig. 17
Fig 18
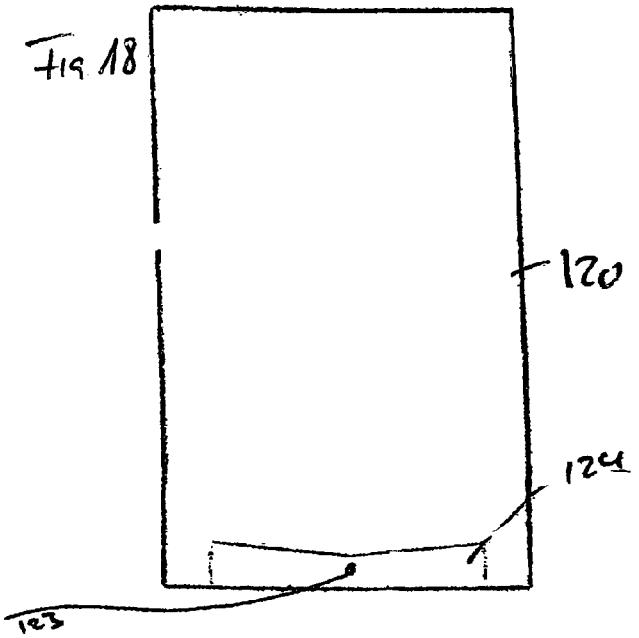

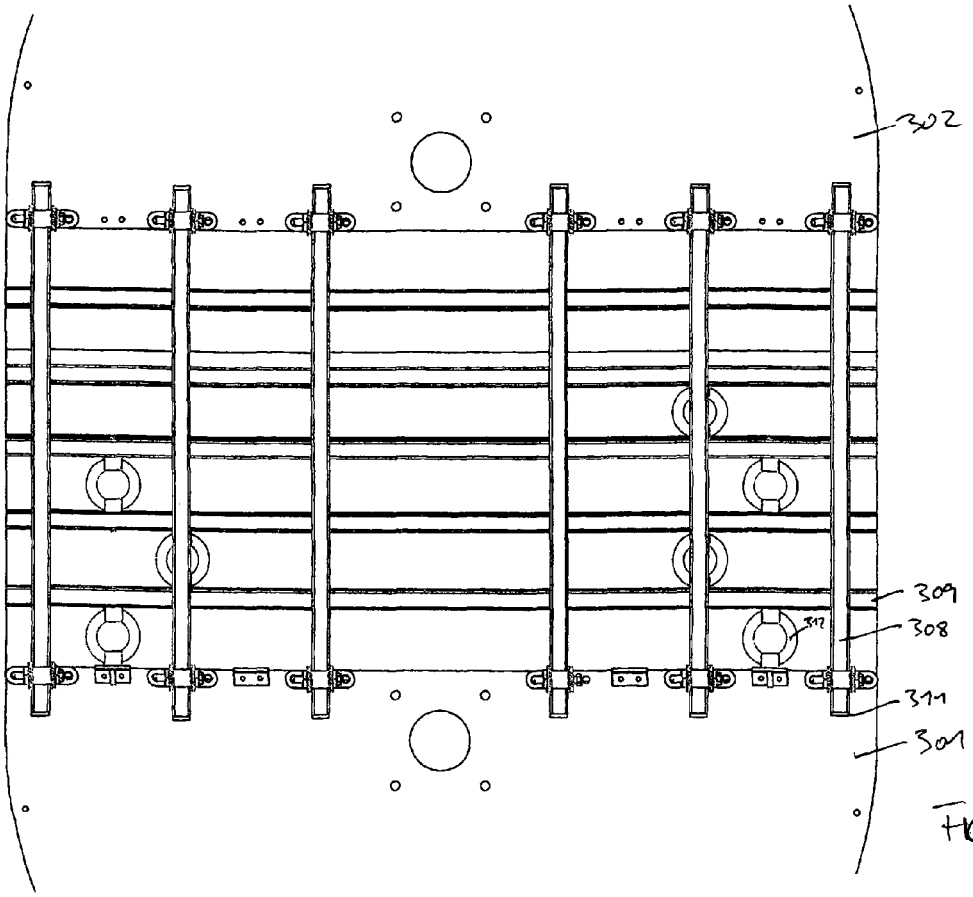
Fig 31
Fig. 32
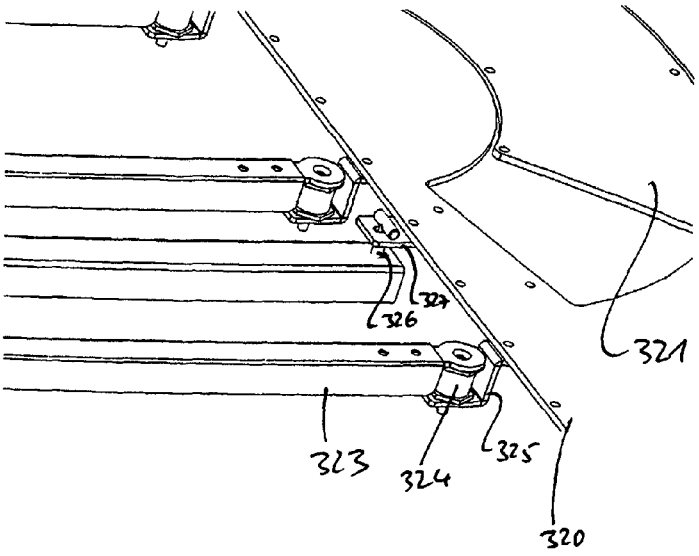

Fig. 33
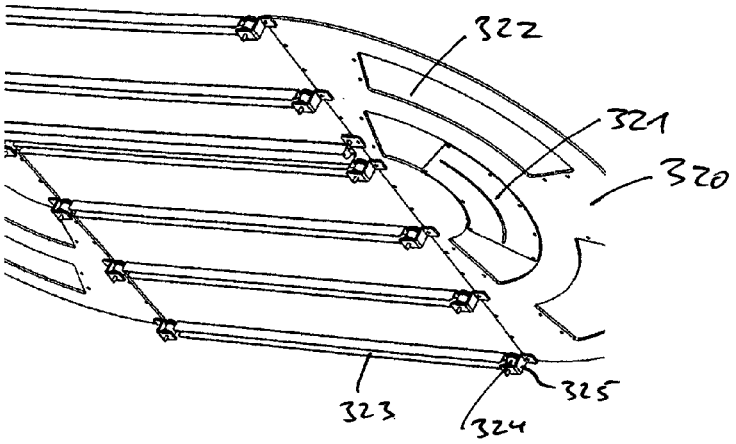
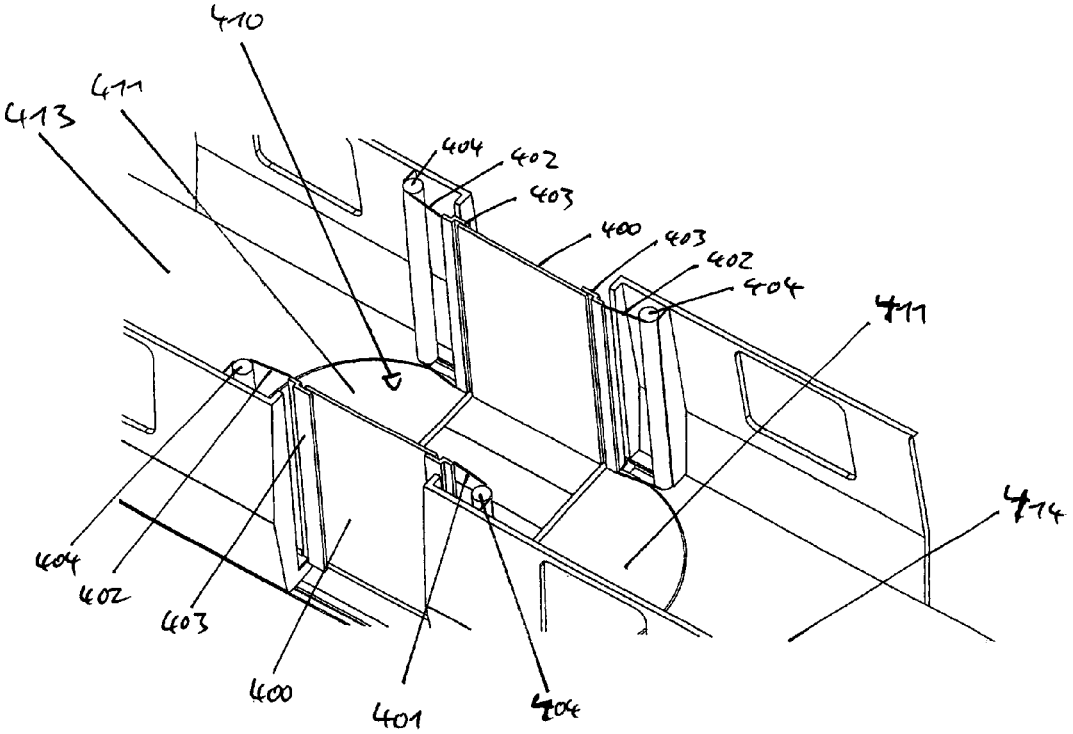
Fig. 34

GANGWAY FLOOR FOR A GANGWAY BETWEEN A FIRST CAR OF A MULTI-CAR VEHICLE AND A SECOND CAR OF SAID VEHICLE

CROSS-REFERENCE TO RELATED APPLICATIONS

This application is the national stage application under 35 U.S.C. §371 of International Application No. PCT/EP2012/005144 and claims the benefit of Intl. Application No. PCT/EP20121005144, filed Dec. 13, 2012, and European Application No. 11009818.3, filed Dec. 13, 2011, European Application No. 12000360.3, filed Jan. 20, 2012, European Application No. 12004117.3, filed May 29, 2012, European Application No. 12005979.5, filed Aug. 21, 2012, European Application no. 12005978.7, filed Aug. 21, 2012, European Application No. 12006535.4, filed Sep. 18, 2012, and European Application No. 12006533.9, filed Sep. 18, 2012, the entire disclosures of which are incorporated herein by reference in their entireties.

The invention pertains to a gangway floor for a gangway between a first car of a multi-car vehicle and a second car of said vehicle, a gangway and a multi-car vehicle.

Multi-car vehicles are known in different designs and in different forms of adaptation for uses. Multi-car vehicles, for example, railway-bound trains (street cars and subway-trains also being considered as such trains) are known and are known for the purpose of transporting passengers as well as transporting goods. Further types of multi-car vehicles can be magnetic railway trains or can be buses (road buses as well as buses travelling on fixed tracks). A car of a multi-car vehicle can be a self-supporting cars, whereby the car has sufficient wheels that are placed at sufficient locations such that the car can stand by itself without being supported by other cars, for example a three-wheeled car, a four wheeled car or a car with even more wheels placed suitable locations. A car of a multi-car vehicle can also be of the non-self-supporting type, whereby the car has no wheels or only wheels provided in such number or arranged at such a place that the car can not stand by itself, but is vertically supported by at least one neighbouring car.

To form the multi-car vehicles, the individual cars of the vehicle are connected to one another by means of a connecting device. The connecting devices can be provided for different types of purposes. In multi-car vehicles where only one or only several of the total of cars is driven, the connecting devices are provided so that a driven car can drive a non-driven car and thus ensure that the complete vehicle travels with the same speed. Connecting devices are also distinguished between those connecting devices that allow for an easy decoupling of the cars, whereby easy decoupling is understood to be accomplished within a couple of minutes, or for what is called "semi-permanent" coupling of the cars, for which decoupling of the cars takes efforts and usually involves the vehicle to have been transported to a specific work shop. Trains, for example, can have coupler-heads as part of their connecting devices. These coupler-heads can, for example, be so called "automatic couplers" that allow decoupling within minutes.

It is an object of the invention to provide solutions that do away with at least one of the problems of the prior art.

This problem is solved by the subject matter of the independent claims. Preferred embodiments are given in the subordinate claims and the description following hereafter.

The invention makes use of the basic idea of providing a gangway floor for a gangway between a first car of a multi-car vehicle and a second car of said vehicle comprising a first floor panel and a second floor panel, whereby the first floor panel is arranged to rotate about a first axis that does not lie in the plane that the first floor panel lies in and the second floor panel is arranged to rotate about a second axis that does not lie in the plane that the second floor panel lies in, whereby the first axis is different to the second axis. The rotation might take place relative to other parts of the gangway floor, other parts of a gangway that the gangway floor is built into or relative to a car of a multi-car vehicle that has a gangway arranged between a first car and a second car, with the gangway floor being a part of this gangway. Providing the gangway floor with such a design allows the cars of the multi-car vehicle to take up a multitude of relative positions to each other, which facilitates the movement of the multi-car vehicle along parts that are different from the straight line, be it for moving around bends or be it for moving over uneven surfaces and for example over the top of a hill.

In a preferred embodiment, the first axis is perpendicular to the plane that the first floor panel lies in the normal, straight line driving condition of the gangway floor. Additionally or as an alternative, in a preferred embodiment the second axis is perpendicular to the plane that the second floor panel lies in the normal, straight line driving condition of the gangway floor. In a preferred embodiment, the first axis and/or the second axis cross the centreline of the gangway floor, which is to be understood to be the line in the middle of the gangway floor that points from the end of the gangway floor that points towards the first car towards the end of the gangway floor that points towards the second car. In a symmetrically designed gangway floor, the centreline is the line of symmetry that that points from the end of the gangway floor that points towards the first car towards the end of the gangway floor that points towards the second car.

In a preferred embodiment, the first floor panel is arranged inside a cut-out provided in a neighbouring floor panel next to the first floor panel and arranged to be able to rotate about the first axis inside the cut-out relative to the neighbouring floor panel, whereby the first floor panel and/or the cut-out has the shape of a sector of a circle or the shape of a segment of a circle or the shape of the segment of a ring. Likewise, in a preferred embodiment the second floor panel is arranged inside a cut-out provided in a neighbouring floor panel next to the second floor panel and arranged to be able to rotate about the second axis inside the cut-out relative to the neighbouring floor panel, whereby the second floor panel and/or the cut-out has the shape of a sector of a circle or the shape of a segment of a circle or the shape of the segment of a ring. In a preferred embodiment, the shapes of the cut-out and the panel set into the cut-out are essentially the same, preferably some clearance between them allowing for a good relative movement. However, embodiments can also be thought of, where the panel and the cut-out have different shapes. In such embodiments, the cut-out is preferably designed larger than the panel set into the cut-out in order to allow the panel to rotate about the first axis inside the cut-out relative to the neighbouring floor panel. Embodiments can for example be thought of, where the cut-out is the shape of a segment of a circle and the first panel has the shape of the segment of an octagon or is even partially square in its shape. Such embodiments would still allow the first panel to rotate about the first axis inside the cut-out relative to the neighbouring floor panel, if the cut-out in the shape of the segment of a circle is chosen large enough.

Independent from the above described basic idea, but also as a preferred embodiment of this idea, the invention can also be put into practice by providing a gangway floor of a gangway between a first car of a multi-car vehicle and a second car of said vehicle with a first floor panel that has the shape a sector of a circle or the shape of a segment of a circle or the shape of a sector of a ring and a second floor panel with a shape of a sector of a circle or the shape of a segment of a circle or the shape of a sector of a ring. Providing the gangway floor panel with such shapes on the respective ends allows the cars of the multi-car vehicle to take up a multitude of relative positions to each other, which facilitates the movement of the multi-car vehicle along parts that are different from the straight line, be it for moving around bends or be it for moving over uneven surfaces and for example over the top of a hill.

In a preferred embodiment, the radius of the circle to which the shape of the first floor panel is a sector or a shape of is the same radius of the circle to which the shape of the second floor panel is a sector or a segment of.

In a preferred embodiment, the centre of the circle of which the shape of the first floor panel is a sector or a segment of differs from the centre of the circle of which the shape of the second floor panel is a sector or a segment of. This allows for the gangway floor of the gangway to be designed and built into a multi-car vehicle in such a manner that if the connection device that connects the first car with the second car has two joints placed along the longitudinal extent of the connection device, which allow pivot movements of parts of the connecting device about two pivot axis, the pivot axis of the connection device can be made to coincide with the respective center of the circles. It has been seen that such an alignment of the center of the circle for the design of the first and second floor panel with the pivot axis of the connecting device allows to harmonize the movement of the connection device with the movement of the gangway floor. In a preferred embodiment, the first floor panel is arranged to rotate about a first axis which coincides with the center of the circle to which the shape of the first floor panel a sector or a segment of. The rotation of the first panel takes place relative to other parts of the gangway floor, other parts of the gangway or the car proximate the first floor panel. In a preferred embodiment the second floor panel is also arranged to rotate about a second axis, which perfectly coincides with the center of the circle to which the shape of the second floor panel is a sector or a segment of.

In a preferred embodiment, the shape of the first floor panel and the shape of the second floor panel is the same. This allows for the gangway floor to be easily arranged in a symmetric manner along the gangway.

The first floor panel and the second floor panel can be parts of a unitary floor panel. They can for example be the end sections of a unitary floor panel. In a preferred embodiment, however, the first floor panel and the second floor panel form part of a multi-part group of elements. For example the first floor panel can be the end part at one end and the second floor panel can be the end part at the opposite end of a group of elements, both floor panels being joined by intermediate elements, arranged between the first floor panel and the second floor panel joining the first floor panel to the second floor panel.

In a preferred embodiment, the first floor panel is connected to the second floor panel by at least a third panel. In a preferred embodiment, this third panel can have a rectangular shape. In a different embodiment, the third panel can have the shape, which together with the first panel and the second panel in a preferred embodiment having the shape of a semicircle each makes up the shape of a peanut.

In a preferred embodiment a multitude of rectangular floor panels are provided in parallel to one another and each rectangular floor panel being attached both to the first floor panel and the second floor panel. In an alternative embodiments, rectangular floor panels could be provided, which are arranged side-by-side with respect to their longer sides, the one of the rectangular floor panels arranged next to the first floor panel being attached along its one longer side to the first floor panel, the one of the rectangular floor panels arranged next to the second floor panel being attached along its one longer side to the second floor panel, the remaining rectangular floor panels being arranged between these two rectangular floor panels.

In a preferred embodiment the first floor panel is configured to have the shape of a sector of a circle or the shape of a segment of a circle and the second floor panel is configured to have the shape of a sector of a circle or the segment of a circle and at least one rectangular floor panel (a third panel) is arranged between the first floor panel and the second floor panel, joining the first floor panel to the second floor panel. While it is possible that the rectangular floor panel arranged between the first floor panel and the second floor panel is not attached to both the first floor panel and the second floor panel, but for further elements to be arranged between the rectangular floor panel and the respective first or second floor panel, in a preferred embodiment at least one rectangular floor panel is provided that is attached to the first floor panel at one end and to the second floor panel at the other end. This can lead to a rigid design of the gangway floor. In an even preferred embodiment, a multitude of rectangular floor panels are provided, the rectangular floor panels being arranged in parallel to another and each rectangular floor panel being attached at one end to the first floor panel and the other end to the second floor panel. In an alternative embodiments, rectangular floor panels could be provided, which are arranged side-by-side with respect to their longer sides, the one of the rectangular floor panels arranged next to the first floor panel being attached along its one longer side to the first floor panel, the one of the rectangular floor panels arranged next to the second floor panel being attached along its one longer side to the second floor panel, the remaining rectangular floor panels being arranged between these two rectangular floor panels.

In a preferred embodiment the third panel is connected to the first panel in a flexible manner that allows linear and/or rotational movements of the third panel relative to the first panel. A flexible connection can be provided by flexible material, but can also be provided by hinges.

In a preferred embodiment the one (or in a preferred embodiment: the multitude of) rectangular floor panel(s) is/are attached to the first floor panel by means of a hinged connection, the hinged connection either allowing the rectangular floor panel to swivel relative to the first floor panel about the line of connection between the rectangular floor panel and the first and second floor panel respectively or allowing the rectangular floor panel to both swivel relative to the first floor panel about the line of connection and to swivel about an axis perpendicular to the line of connection. In an even preferred embodiment, the rectangular floor panel(s) is/are attached to the second floor panel in a similar hinged connection. Attaching the rectangular floor panel(s) to the first floor panel in a hinged manner allows for the first floor panel to be arranged such that it essentially stays in the same plane as a floor of the car of the multi-car vehicle, while the relative position of the rectangular floor panel relative to the first floor panel can allow for misalignment between the first car and the second car, for example if the floor of the first car is in certain driving conditions in a higher plane than the floor of the second car or if the floors of the cars are not in parallel planes, for example if the multi-car vehicle is driving over the tip of a hill. These movements are allowed for, if the rectangular floor panel is allowed to swivel about an axis perpendicular to the longitudinal axis of the gangway floor. There are also driving conditions, where the first car and the second car swivel about the longitudinal axis of the gangway floor, for example situations where the top of the first car is leaning towards the right and the top of the second car is leaning towards the left. Such a twisting of the cars can be allowed for, if the rectangular floor panel is allowed to swivel relative to the first floor panel about the longitudinal axis of the gangway floor.

In a preferred embodiment, the hinged connection is provided by means of a separate axle and a bearing arrangement being provided.

In a different embodiment, the hinged connection can be provided by a protrusion on the one panel that interacts with a recess on the other panel.

In the embodiment, where the first floor panel is arranged to rotate about a first axis and the second floor panel is arranged to rotate about the second axis, it is preferred, if the distance between the first axis and the second axis is larger than 1.1 times the radius of the circle, preferably larger than 1.4 times the radius of the circle to which the shape of the floor panel is a sector or a segment of.

In a preferred embodiment, at least one of the first floor panel or second panel is set into a cut-out of a connector plate, whereby the cut-out has the shape of a sector of a circle, the shape of a segment of a circle or is a circle and is either horizontally supported by the connector plate or horizontally supports the connector plate. The connector plate can be used to connect the first floor panel or second floor panel respectively to a car of the multi-car vehicle. Placing the first floor panel or the second floor panel in such a cut-out allows for the first floor panel or second floor panel respectively to be in a position to swivel relative to the cut-out, the cut-out being suitable to be attached to the car in a rigid manner and remaining in the same position relative to the car in all driving conditions. That said, designs can be thought of, where the connector plate substantially stays in the same position relative to the car, but whereby the connection of the connector plate to the car includes damping elements that allow for a little movement between the connector plate and the car, for example to take up the rattle that takes place during the normal driving conditions of a train, for example. These damping elements could also be used to allow for movement that becomes necessary between the connector plate and the car, if this interface of connector plate to car is to be used to take up relative movements that may occur between gangway and car in buff or draw driving conditions.

In a preferred embodiment, roller elements, like balls, cylinders, especially needles, drums, bevels, cones or truncated cones, cylinders, balls or wear pads, that may be resin impregnated with friction reducing additives, are provided between the connector plate and the first floor panel or second floor panel to facilitate the movement of the floor panel relative to the connector plate.

In a preferred embodiment, a holding plate is provided that holds the first floor panel or second floor panel inside the cut-out of the connector plate. This holding plate preferably is arranged on the other side of the first floor panel or second floor panel relative to the connector plate and preferably prevents that the first floor panel or second floor panel jumps out of the cut-out of the connector plate.

In a preferred embodiment, at least one of the panels that make up the gangway floor is made from rubber or rubber reinforced by metal objects and/or reinforced by textile fabric or is made from a different elastic material or is made from metal, for example aluminium.

In a preferred embodiment, at least one floor panel is heated.

In a preferred embodiment, at least one floor panel has a sandwich design and/or has a honey-comb cross section or is in other ways designed to absorb energy during a crash.

In a preferred embodiment a vulcanized top panel is provided that is arranged to cover substantially the complete gangway floor or at least the group of elements that has the first floor panel arranged at the one end and the second floor panel arranged at the other end.

In a preferred embodiment, the gangway floor has floor panels that are moveable, preferably slidable or can swivel relative to other floor parts and whereby all floor parts have their top surfaces arranged substantially in the same plane. This allows for a smooth surface of the gangway floor and facilitates the passenger crossing of the gangway floor.

In a preferred embodiment, the first floor panel has the shape of a sector of a circle, the shape of a segment of a circle or is a circle, whereby the diameter of the respective circle is larger than 25% of the width of the first and/or second car or the width of the gangway, preferably larger than 50% of the width of the first and/or second car or the width of the gangway, preferably larger than 75% of the width of the first and/or second car or the width of the gangway.

When set into a multi-car vehicle, this aspect of the invention can be implemented by a multi-car vehicle with a first car of the multi-car vehicle and a second car of said vehicle and with a gangway floor for a gangway between the first car and the second car, whereby the first car is connected to the second car by a connection device whereby the gangway floor may be least partially supported in the vertical direction by a support device arranged between a part of the connection device and a part of the gangway floor.

In a preferred embodiment the first car is connected to the second car by means of a semi-permanent coupler or a detachable coupler, the coupler having at least one essential horizontal elongated body (for example a bar) and whereby the gangway floor may be partially supported in the vertical direction by a support element arranged between the horizontal elongated body and the gangway floor. Especially in those designs, where at least one of the floor panels, for example a rectangular floor panel provided in a preferred embodiment of the invention is arranged in such a manner that it can move in unison with the horizontal bar of the semi-permanent coupler or the detachable coupler, this unison of movement of parts of the gangway floor and the horizontal bar of the coupler can be advantageously used to support the floor.

When set into a multi-car vehicle, this aspect of the invention can be implemented by a multi-car vehicle with a first car of the multi-car vehicle and a second car of said vehicle and with a gangway floor for a gangway between the first car and the second car whereby the first car is connected to the second car by a connection device whereby the connection device has at least three parts, whereby a first part of the three parts can rotate relative to a second part of the three parts about the first axis and whereby the second part of the three parts can rotate relative to a third part of the three parts about the second axis.

In a preferred embodiment the first car is connected to the second car by means of a connection device that has an elongated body (for example a bar) that can swivel relative to other elements of the connection device about two parallel, vertical swivel axis or that has two elongated bodies (for example two bars joined to coupler heads of a coupler), each of which can swivel relative to other elements of the connection device about one respective vertical swivel axis, the swivel axis being set in parallel, whereby the first floor panel is arranged to also rotate about one of these swivel axis and the second floor panel is arranged to rotate about the other swivel axis.

The basic idea of the invention as described above to be put into practice by use of a first floor panel that rotates about a first axis and a second floor panel that rotates about a second axis can be advantageously combined with the idea that a side panel of a gangway can be preferably connected to the gangway floor by means of a joint that allows swivel movements about at least one, preferably about two axes that are perpendicularly arranged to one another. If—in a preferred embodiment—only one joint is provided for the side panel and if this only one joint is provided towards the bottom part of the panel, which is the part of the panel closest to the gangway floor, such a joint can allow the top part of the side panel to tilt relative to the gangway floor. This can be advantageous in driving conditions where the cars of the multi-car vehicle are misaligned, for example in situations where the floors of the cars are not in parallel planes but are at an angle to another, for example when the multi-car vehicle is driving over the top of a hill.

In a preferred embodiment, the joint allows for a swivel movement about the axis, that is arranged parallel to the gangway floor and perpendicular to the longitudinal extent of the gangway, which is understood to be the direction, that passengers walk through the gangway. Additionally or alternatively, the joint allows swivel movements about a vertical axis. This also allows for the gangway to allow the cars of the multi-car vehicle to be misaligned in such a manner that the longitudinal axis of the respective cars are not coaxially, but offset in parallel to one another or are at an angle to one another for example when the multi-car vehicle is driving around a bend.

In a preferred embodiment, the joint is housed in a box. This allows for the joint to be protected.

In a preferred embodiment, the side panel of the gangway has a center section with an arch-shaped cross section in the horizontal plane and the panel has end sections that in the same cross section are arch-shaped with a curvature opposite to the arch-shaped of the center section. The center section in a different embodiment can however also be flat. Likewise in a different embodiment, the end sections can also be flat.

This allows for a stable design of the side panel. Preferably the radius of the curvature of the center section is substantially larger than the radius of the curvature of the end sections.

In a preferred embodiment, the side panel has lighting elements that illuminates the panel and/or that illuminates the roof of the gangway.

When placed into a multi-car vehicle, the gangway designed according to the invention is preferably placed into a multi-car vehicle, whereby the first car has a side-wall, whereby the side-wall bends inwards at the end of the first car. This allows for a good interaction between the first car and the gangway side wall.

In a preferred embodiment, the radius of the inwardly bent end of the first car equals to half of the width of the first car. This has proven to be a good design to allow good interaction between side panels of the gangway and the inwardly bent end of the car.

In a preferred embodiment, an end section of the panel of the gangway contacts the side-wall in a region inward of the inwardly bent end of the side wall (inwards towards the middle of the car and the longitudinal direction of the car) when the first car and the second car are aligned in a straight line and whereby the end section of the panel contacts the inwardly bent end of the side wall in at least one operational mode of the multi-car vehicle in which the first car and the second car are not aligned in a straight line, but are arranged at a horizontal and/or vertical angle and/or lateral and/or vertically offset relative to one another. This allows for the panel of the gangway to stay in contact with the inwardly bent end of the first car in operational modes of the multi-car vehicle and prevents an opening to be created in operational modes of the multi-car vehicle between the gangway and the car itself.

In a preferred embodiment, the surface of the side wall that is in contact with the end section of the panel is adapted to allow sliding between the end section of the panel with reduced friction. This can be achieved by choosing the material of the respective section of the side wall of the gangway that comes into contact with the end section of the panel.

The invention relates also to a multi-car vehicle with a first car of the multi-car vehicle and a second car of said vehicle, the first car and the second car being connected by making use of any one of the embodiments of the assembly of parts as defined to pertain to the invention.

The invention also pertains to a multi-car vehicle with a first car of the multi-car vehicle and a second car of said vehicle, the multi-car vehicle being provided with a gangway that has a gangway floor according to any one of the embodiments of the invention described.

The invention also pertains to a multi-car vehicle with a first car of the multi-car vehicle and a second car of said vehicle. The multi-car vehicle having a gangway arranged between the first car and the second car designed according to any of the designs of the gangway of the invention as described herein.

According to a further aspect of the invention, the invention makes use of the idea that a connection between the first car and the second car of a multi-car vehicle, if it can be designed with reduced height can be arranged in such a manner, that it is substantially in the same horizontal plane as the frames of the supporting frame that support the floor of the first car. This allows for forces that are transmitted along the multi-car vehicle to be transmitted in a straight line and for doing away with having to divert this horizontal forces into a lower plane, in which the connection might be arranged.

In this sense the basic idea of the invention as described above to be put into the practical use of floor panels having the shape of a sector of a circle or a segment of a circle can be advantageously combined with a multi-car vehicle with a first car of the multi-car vehicle and a second car of said vehicle the first car and the second car having an elongated body suitable for transmitting the pushing force required to push the first car in front of the second car, when the second car is moving, the elongated body having a longitudinal axis, a connection suitable to connect the elongated body to the first car or the second car and suitable to transmit the pushing force from the second car to the elongated body or from the elongated body to the first car, the first car and or the second car having an underframe, that comprises at least one longitudinal beam and/or at least one cross beam, whereby the elongated body is arranged approximately at the same vertical level as the longitudinal beam and/or the cross beams and/or is arranged in such a manner that with regard to the vertical direction the elongated body at least partially overlaps with the beams.

In a preferred embodiment the underframe has a central longitudinal beam that is arranged approximately along the longitudinal axis of the first car, whereby the elongated body is arranged approximately at the same vertical level as central longitudinal beam and/or is arranged in such a manner that with regard to the vertical direction the bar at least partially overlaps with the central longitudinal beam.

In a preferred embodiment the underframe has a cross beam supported by a bogie, whereby the elongated body is arranged approximately at the same vertical level as cross beam supported by the bogie and/or is arranged in such a manner that with regard to the vertical direction the elongated body at least partially overlaps with the cross beam supported by the bogie.

In DIN 25603, Blatt 1 (version of September 1966), DIN 25603, Blatt 2 (version of October 1966), DIN 25603, Blatt 3 (version of December 1967), DIN 25603, Blatt 4 (Version of December 1967) and DIN 25603, Blatt 5 (Version of December 1967), DIN 25603 (Version of June 1969) underframes of different types of cars of different types of multi-car vehicles. The term "longitudinal beam" as used in the claims and the description of this invention is to be understood to at least encompass beams that are designed and/or arranged like any one of the "Langtraeger" mentioned in those DIN. Likewise the term "cross beam" as used in the claims and the description of this invention is to be understood to at least encompass beams that are designed and/or arranged like any one of the "Quertraeger" mentioned in those DIN. The terms "longitudinal beam" and "cross beam" are preferably, however, not to be understood to be limited to only refer to exactly that design and shape of the "Langtraeger" and "Quertraeger" as shown in those DIN. It is known to the person skilled in the art that the underframe of cars of multi-car vehicles is adapted in many way to suit the specific design of the car and/or to suit the specific statics of the car. For example, designs are known, where of the elements used to transmit horizontal forces through the car, only towards the respective end of the car, longitudinal beams are provided as underframe, while in the middle of the car, the surrounding structure (for example the walls and the floor) of the car are used to transmit the horizontal forces through the car. The basic concept of the invention is to avoid having to re-direct horizontal forces into a lower vertical plane specifically only for them to be introduced into the connection. For this reason the basic concept of the invention is to place the connection and especially the elongated body of the connection device at or at least as close as possible to the a vertical level at which the elements of the construction of the car are placed that pass the horizontal forces along beams. It is also known to the skilled person that for specific types of multi-car vehicles, the car is—at least partially—made up of extruded profiles. These extruded profiles can have sections that are designed to transmit horizontal forces along the longitudinal direction of the car. For these embodiments, the invention can be implemented to understand the term "longitudinal beam" to refer to those sections of an extruded profile that is designed to transmit horizontal forces along the longitudinal direction of the car.

It is known that longitudinal beams of the underframe of a car change their vertical extent along the longitudinal axis. For example DIN 25 603 Blatt 3 shows the longitudinal beam (Langtraeger 15) to widen at two section, namely at the part where the holder for the step (Halter fuer Trittrost 11) is provided and at the section where the beam for the central buffer coupling (Traeger fuer Mittelpufferkupplung 18) is provided. In a preferred embodiment the term "at the same vertical level as the longitudinal beam and/or the term "is arranged in such a manner that with regard to the vertical direction the elongated body at least partially overlaps with the beams" is understood to refer those sections of the beams that have the minimal vertical extent necessary to fulfil their purpose of transmitting horizontal forces along the car.

As stated above, in a preferred embodiment the central beam is not designed to widen its cross section substantially in the vertical direction towards the end of the first car. As an example, with the invention the widening of the longitudinal beams (Langtraeger 15) in DIN 25 603 Blatt 3 at the right hand side of the car at the section, where the beam for the central buffer coupling (Traeger fuer Mittelpufferkupplung 18) is provided, can be avoided.

In a preferred embodiment, the connecting device comprises a first coupler head and a second coupler head that can be coupled to one another, but also allows the first car of the multi-car vehicle to be separated from the second car of the multi-car vehicle.

In a preferred embodiment, the multi-car vehicle is a rail-bound train and in a preferred embodiment a rail-bound train suitable to travel faster than 100 km/h.

The invention is preferably used in railway-bound trains (street cars and subway-trains also being considered as such trains), be it for the purpose of transporting passengers or for the purpose of transporting goods. Further uses of the multi-car vehicles can for example be magnetic railway trains or can be buses (road buses as well as buses travelling on fixed tracks). A car of a multi-car vehicle can be a self-supporting car, whereby the car has sufficient wheels that are placed at sufficient locations such that the car can stand by itself without being supported by other cars, for example a three-wheeled car, a four wheeled car or a car with even more wheels placed at suitable locations. A car of a multi-car vehicle can also be of the non-self-supporting type, whereby the car has no wheels or only wheels provided in such number or arranged at such a place that the car can not stand by itself, but is vertically supported by at least one neighboring car. Further uses can be moveable gangways of airports.

Figure 2:
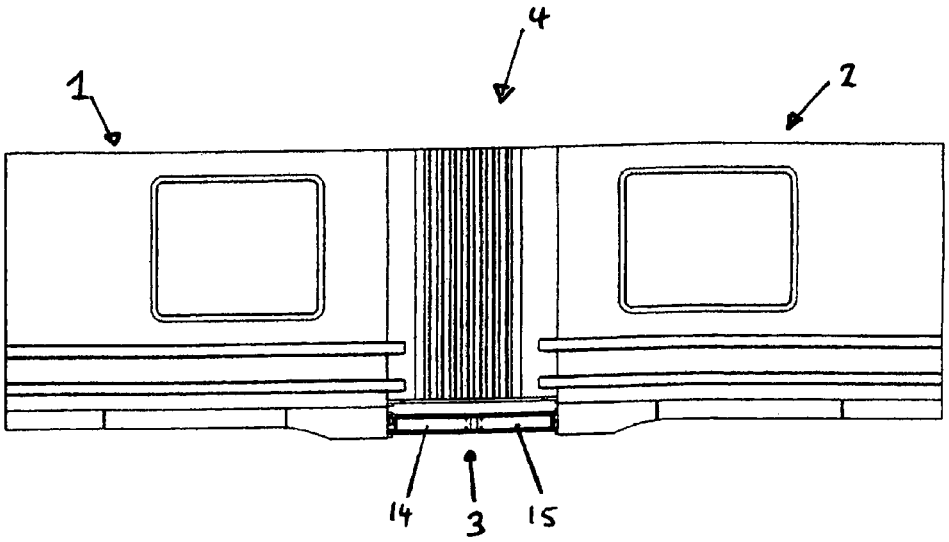
Figure 3:
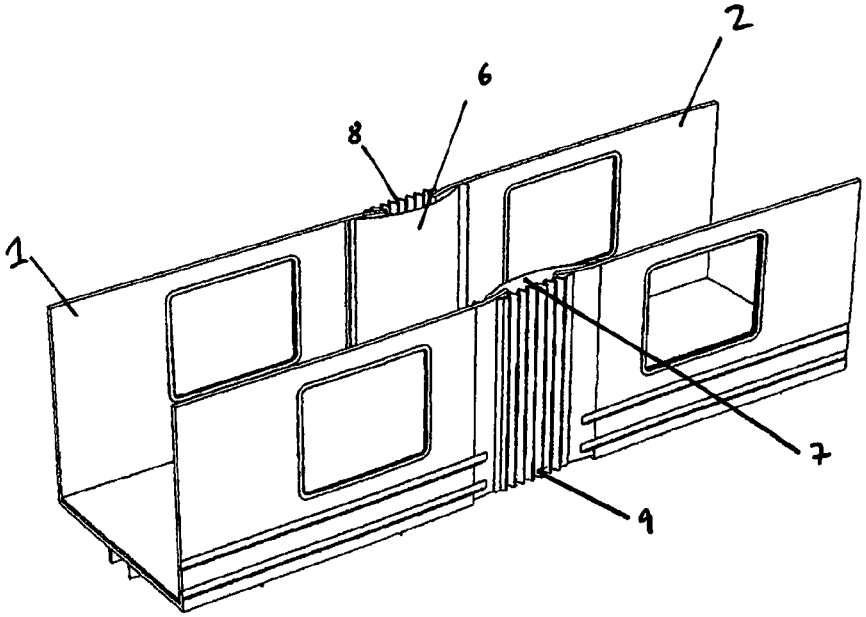
Figure 4:
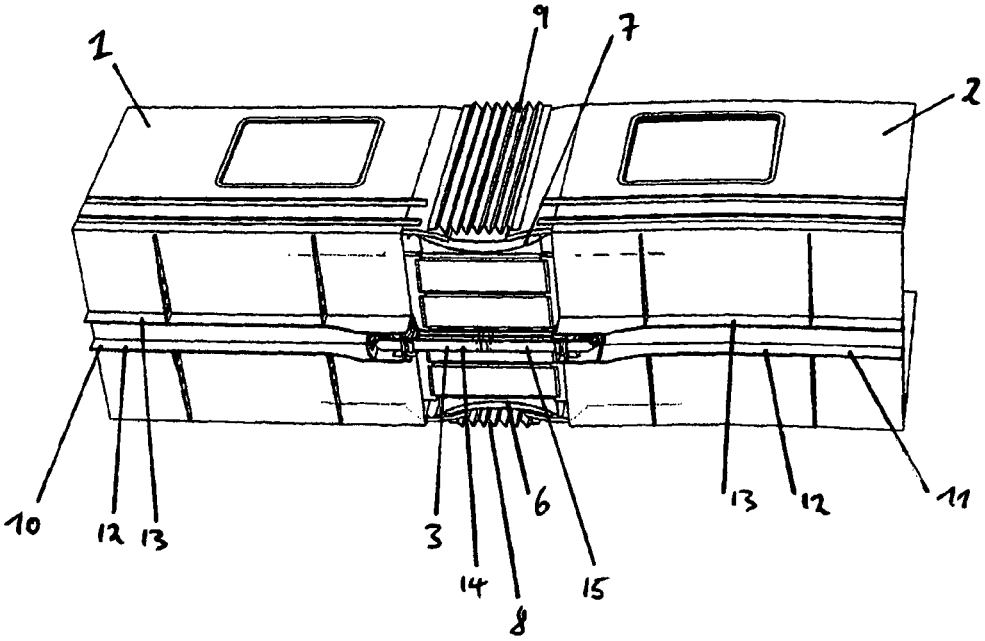
Figure 7:
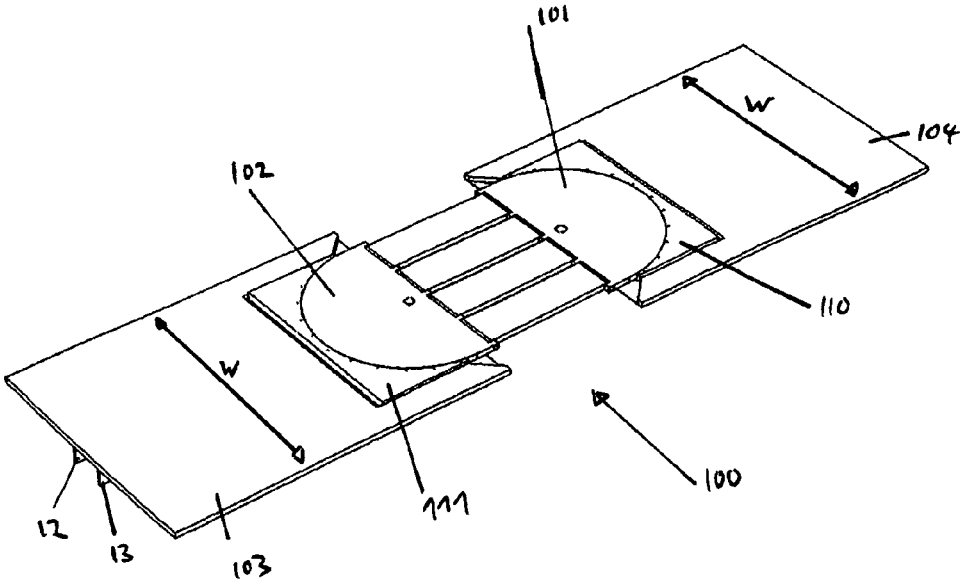
Figure 8:
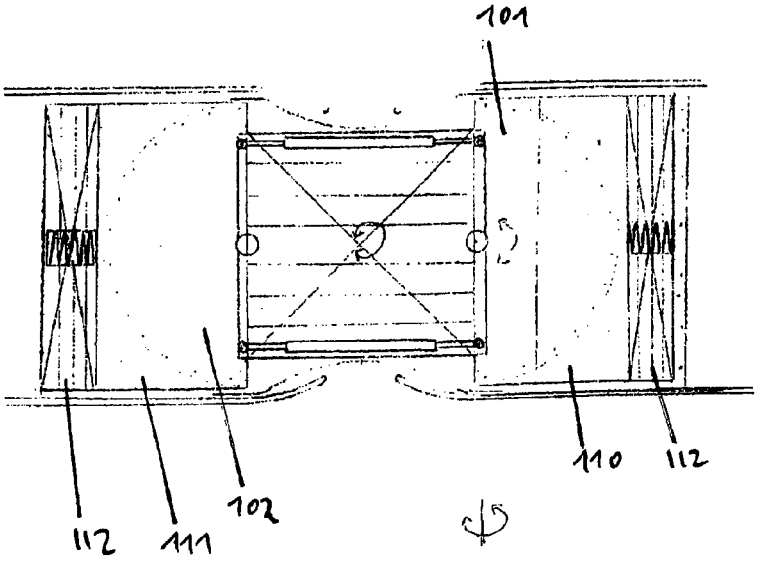
Figure 9:
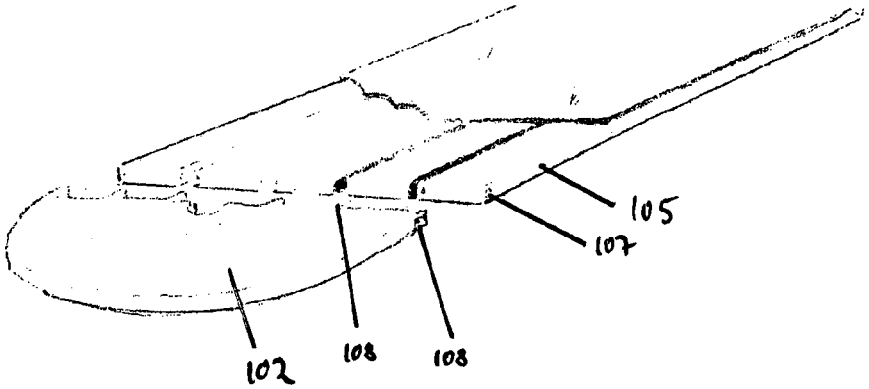
Figure 10:
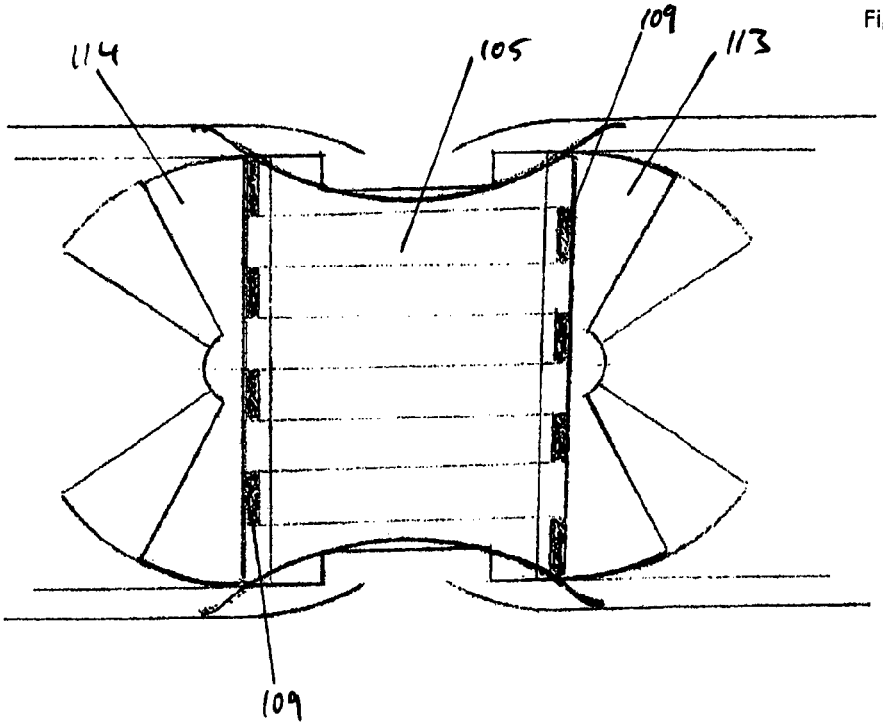
Figure 11:
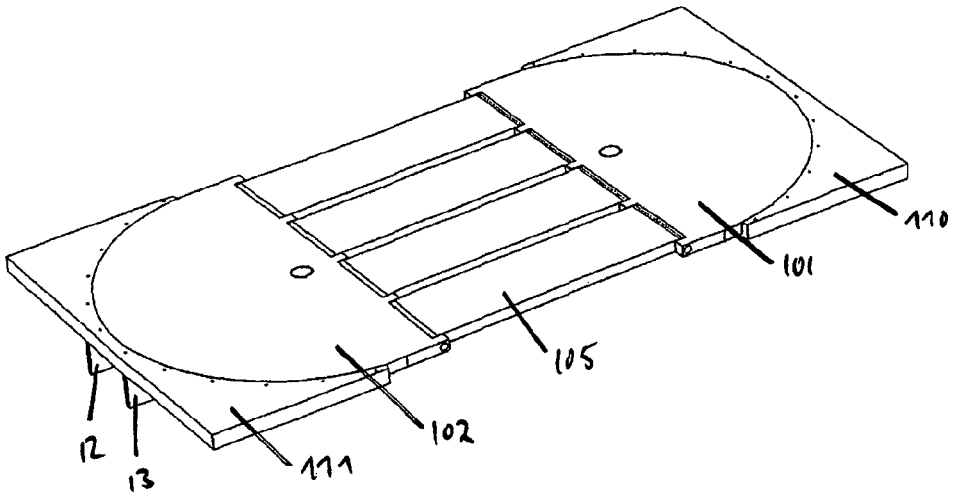
Figure 12:
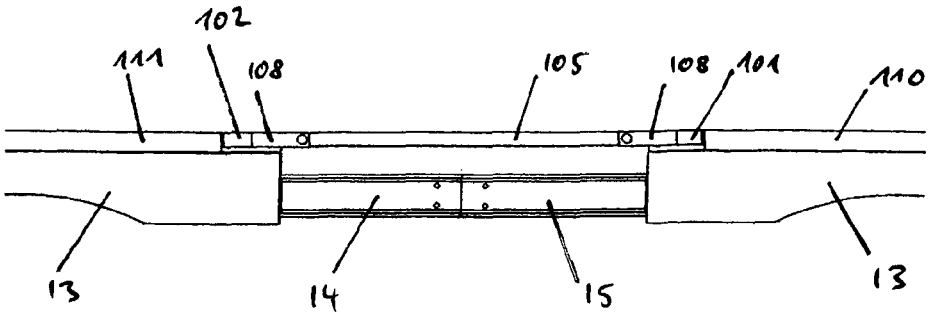
Figure 15:
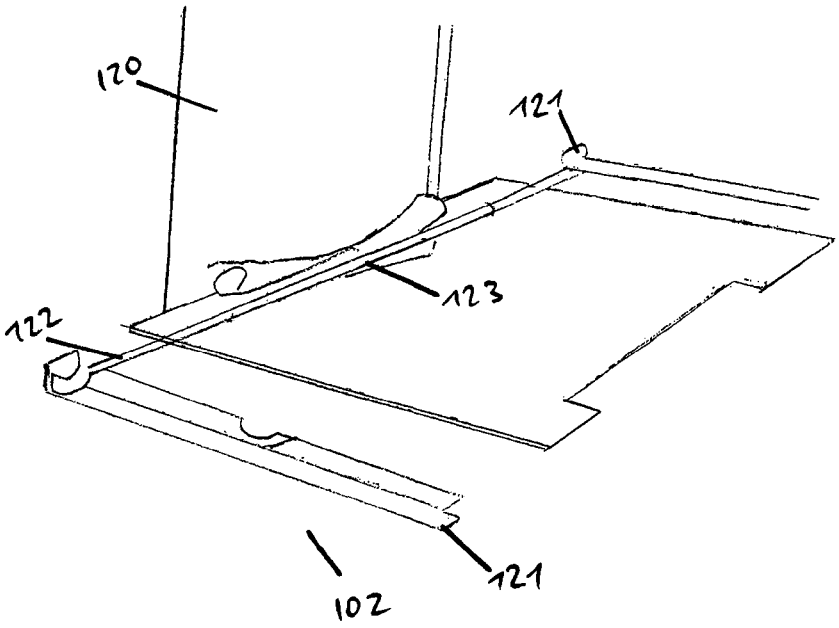
Figure 16:
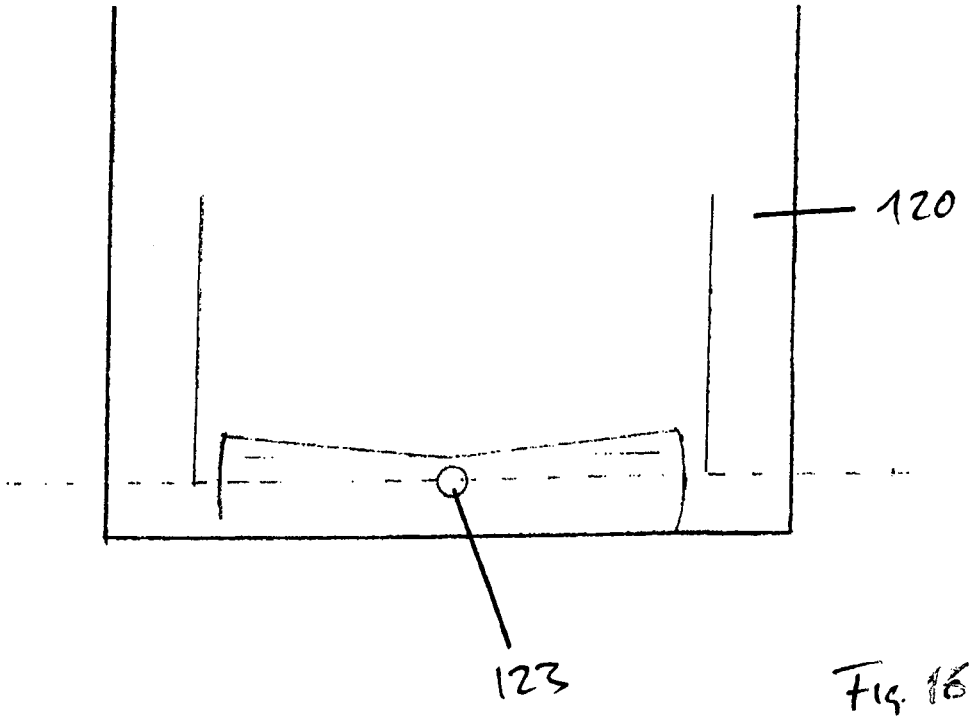
Figure 19:
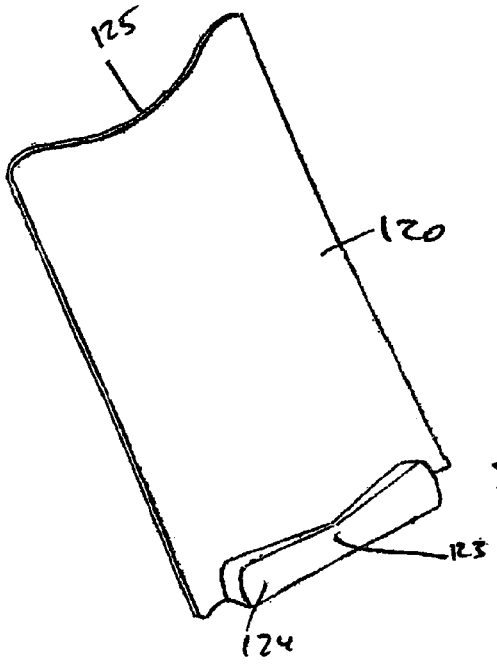
Figure 20:
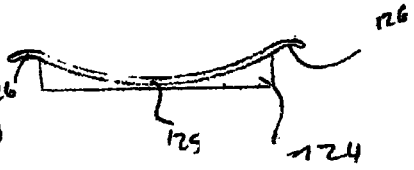
Figure 21:
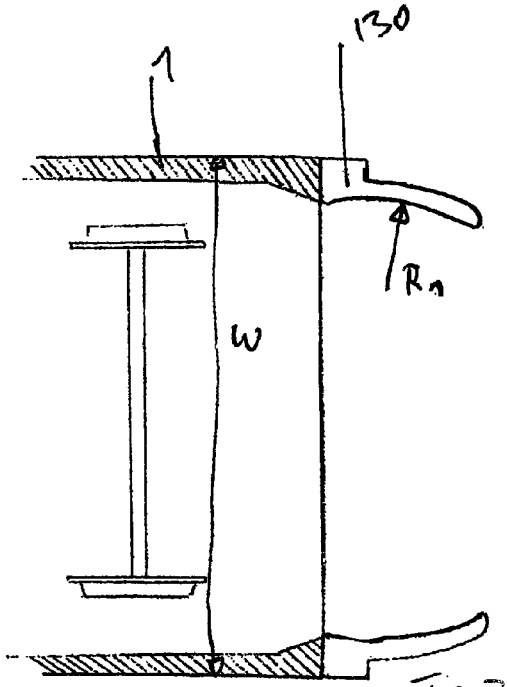
Figure 22:
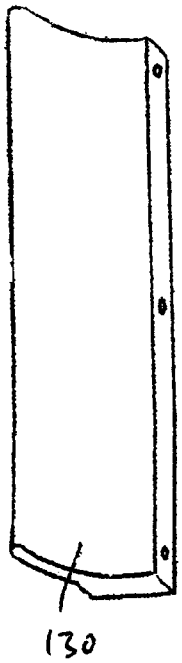
Figure 23:
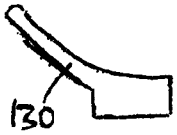

Below embodiments of the invention will be described with reference to the figures. The figures represent the following:

FIG. 1 a top perspective view onto the ends of a first car and a second car of a multi-car vehicle connected by a connecting device, the roof of the cars having been cut away for illustration purposes;

FIG. 2 a side view of the ends of a first car and a second car that are shown in FIG. 1;

FIG. 3 a further perspective view onto the ends of a first car and a second car that are shown in FIG. 1;

FIG. 4 a perspective view from below onto the ends of a first car and a second car that are shown in FIG. 1;

FIG. 5 a further perspective view from below onto the connecting device being connected to the first and the second car;

FIG. 6 a schematic perspective view of the gangway floor for a gangway between a first car of a multi-car vehicle and a second car of said vehicle;

FIG. 7 a schematic perspective view of the gangway floor arranged between the floor of the first car and the floor of the second car;

FIG. 8 a top view onto the gangway floor being arranged between the first car and the second car;

FIG. 9 a schematic perspective view of panels of the gangway floor before they are being connected to each other;

FIG. 10 a schematic top view onto a second embodiment of a gangway floor between the floor of the first car and the floor of the second car;

FIG. 11 a top perspective view onto the gangway floor being arranged between the first car and the second car in the embodiment shown in FIGS. 7 to 9;

FIG. 12 a side view onto the gangway floor being arranged between the first car and the second car in the embodiment shown in FIGS. 7 to 9;

FIG. 13 a perspective view from below onto the gangway floor being arranged between the first car and the second car in the embodiment shown in FIG. 7 to 9;

FIG. 14 parts of a gangway to be arranged between the first car and the second car in a perspective view, FIG. 15 the parts of FIG. 13 and further parts of a gangway to be arranged between the first car and the second car in a perspective view, FIG. 16 a side view onto a side panel of the gangway, FIG. 17 a perspective view of a part of the panel shown in FIG. 15, FIG. 18 a further side view onto the panel according to FIG. 15, FIG. 19 a further perspective view of the panel shown in FIG. 15, FIG. 20 a top view onto the panel shown in FIG. 15, FIG. 21 a top view onto the end of the first car;

FIG. 22 a perspective view of a side wall element of the side wall of the first car;

FIG. 23 a top view onto the side wall element of FIG. 21

Figure 24:
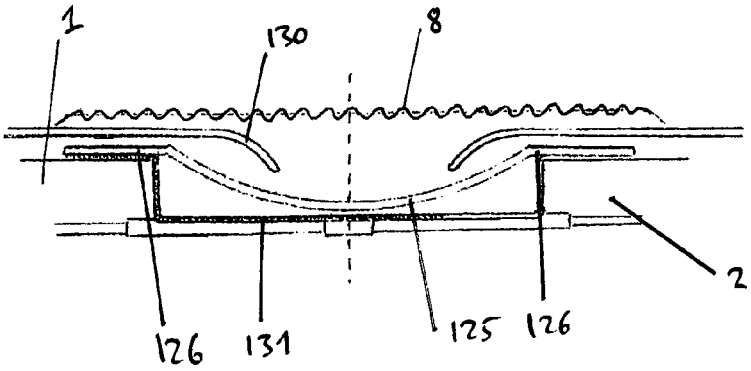

FIG. 24 a top view onto parts of the ends of the first car and the second car as the are being connected by means of parts of the gangway.

Figure 25:
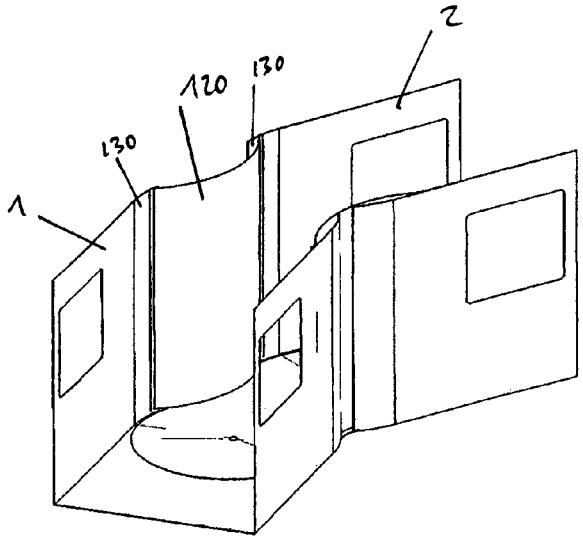

FIG. 25 a top perspective view of the first car and the second car in an operational state, where the multi-car vehicle drives around a bend.

Figure 26:
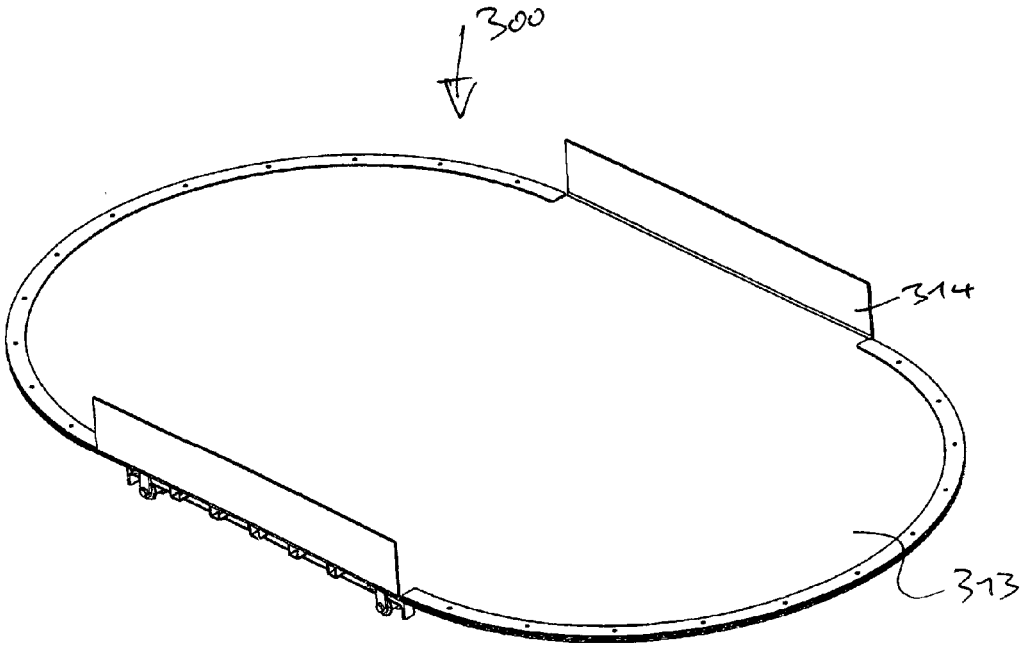

FIG. 26 a perspective view from the top onto a gangway floor

Figure 27:
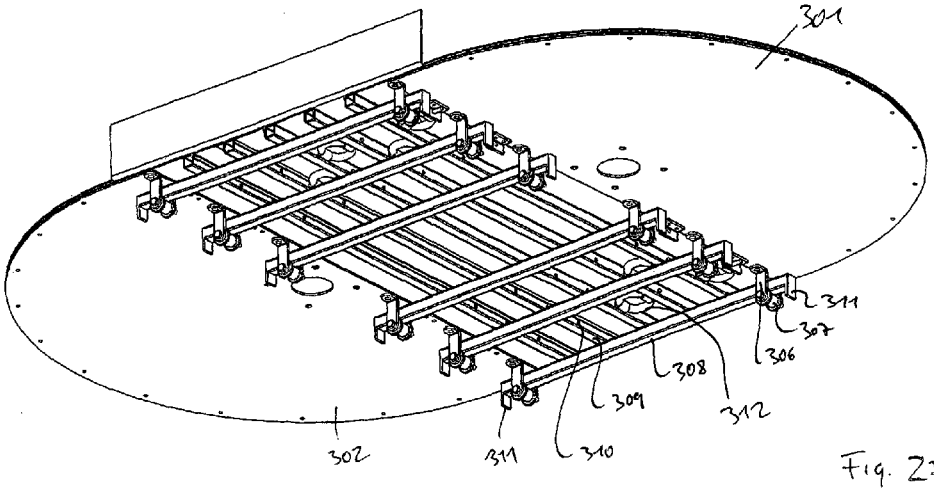

FIG. 27 a perspective view from below onto the gangway floor of FIG. 26

Figure 28:
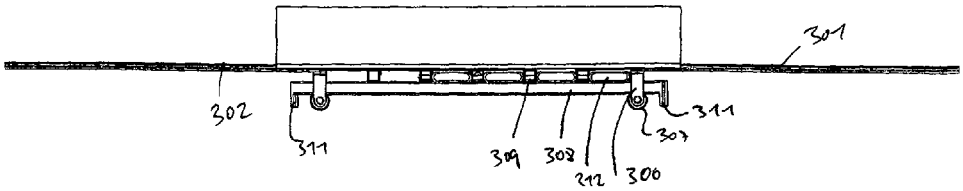

FIG. 28 a side view onto the gangway floor of FIG. 26

Figure 30:
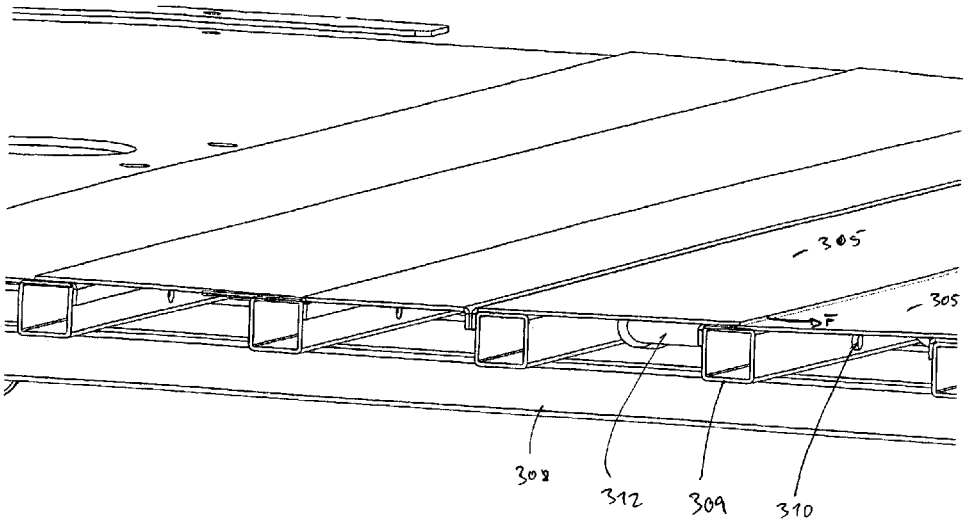
Figure 29:
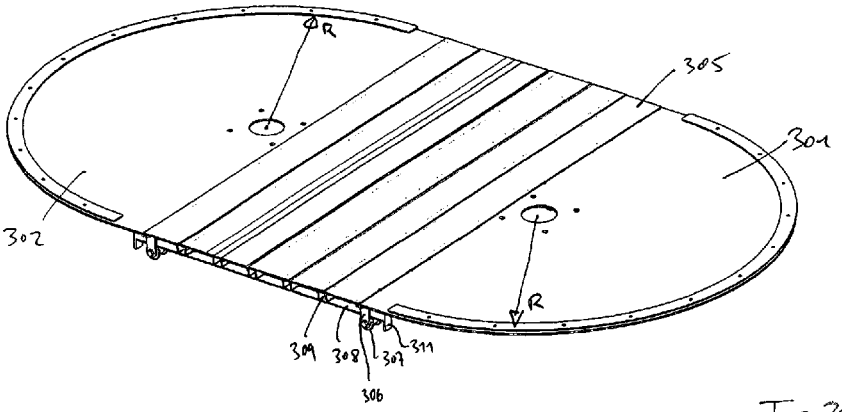

FIG. 29 a perspective view from the top onto the gangway floor of FIG. 26 with the floor cover removed FIG. 30 a perspective close up onto the side of the gangway floor according to FIG. 29

FIG. 31 a view from below onto the gangway floor of FIG. 29

FIG. 32 a perspective view from the top onto a support structure for floor panels of a gangway floor FIG. 33 a perspective view from below onto the support structure as shown in FIG. 32

Figure 38:
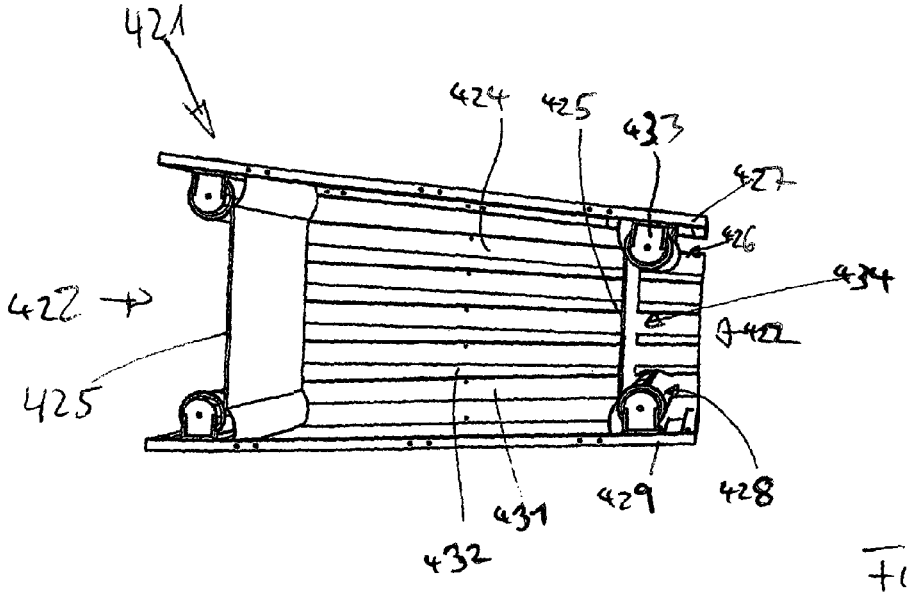
Figure 37:
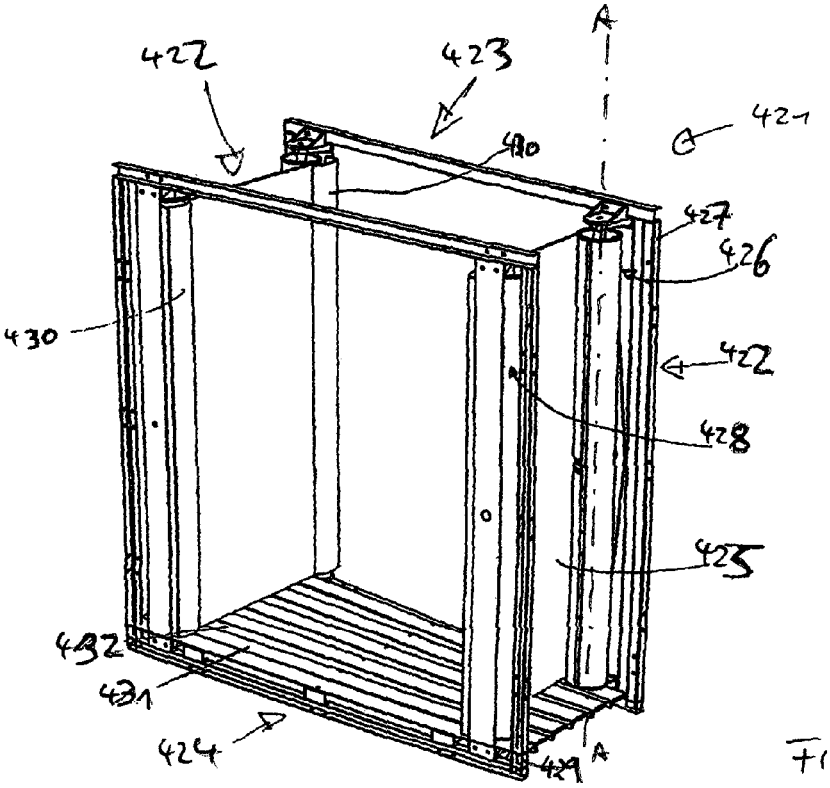

FIG. 34, 35, 36 top perspective views onto the ends of a first car and a second car with a gangway arranged between them in different driving conditions FIG. 37 shows a perspective view onto parts of a gangway according to the invention according to a first embodiment FIG. 38 shows a top view onto the embodiment as shown in FIG. 1

Figure 40:
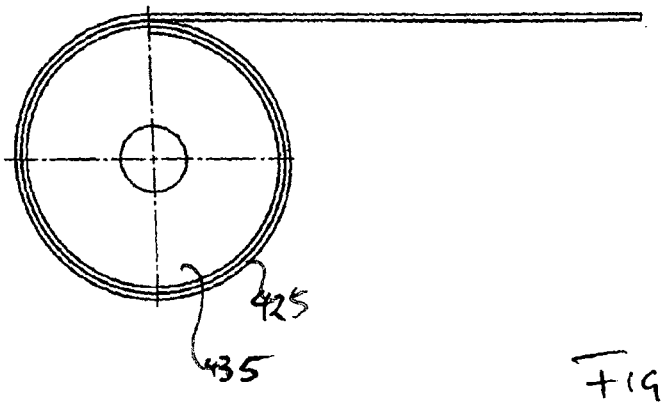
Figure 39:
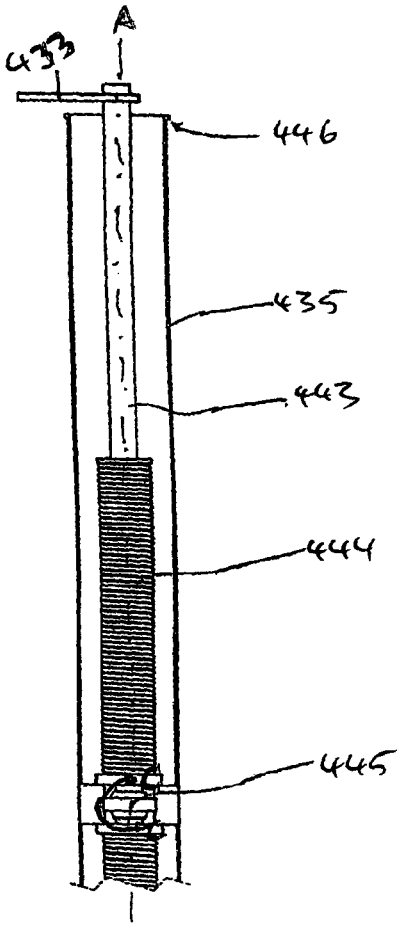

FIG. 39 shows a way to attach a support element in one embodiment of the invention FIG. 40 shows an embodiment where the flexible section of the side panel is wrapped around a support element In the FIGS. 1-4 the view onto the end of a first car 1 and the end of a second car 2 of a multi-car vehicle are shown, the ends being connected by a connecting device 3. A gangway 4 is arranged between the first car 1 and the second car 2 of said vehicle. The gangway 4 has a gangway floor 5 and a first panel 6 and a second panel 7, both panels being arranged substantially vertical. Furthermore, the gangway 6 has bellows 8 and 9.

As can be best seen from FIG. 4, the first car 1 has an underframe (supporting frame) 10 that can also and in a preferred embodiment does support the floor of the first car 1. Likewise, the second car 2 has an underframe (supporting frame) 11 that can also and in a preferred embodiment does supports the floor of the second car 2. The supporting frame 10, 11 is made up from beams. Of these beams, two centrally arranged, parallel beams 12, 13 are shown in FIG. 4. The respective supporting frame of the respective car will typically have more beams than the two beams 12, 13, the further beams not being shown here. The connecting device 3 is arranged between the beams 12, 13 of the first car 1 and the beams 12, 13 of the second car 2. The connecting device 3 has a first bar 14 that is suitable for transmitting a pulling force required to pull the first car 1 after the second car 2 and a pushing force required to push the first car 1 in front of the second car 2, when the second car 2 is moving. The connecting device 3 has a second bar 15 that is likewise suitable for transmitting a pulling force required to pull the first car 1 after the second car 2 and a pushing force required to push the first car 1 in front of the second car 2, when the second car 2 is moving. As can be seen from FIG. 2, the facing ends of bar 14 and bar 15 are connected to each other by means of screws and a connecting plate.

The embodiment of the invention will be described for a multi-car vehicle as it would be used with the second car 2 being driven or the engine for driving the multi-car vehicle being arranged on the side of the second car 2. The embodiment will thus be explained for the situation that the second car 2 is moved by an engine and whereby the connecting device 3 is used to pull the first car 1 behind the second car (for the cases, that the second car 2 is moved towards the right in the FIGS. 1, 2, 3, 4) or whereby the connection device 3 is used for pushing the first car 1 in front of the second car 2 (for the cases, where the second car 2 is moved towards the left in the FIGS. 1, 2, 3, 4). This choice of operational state does, however, not limit the scope of the invention. The invention is also applicable to multi-car vehicles, where the first car 1 is driven or where the engine is arranged on the side of the first car 1 or even for situations, where both, the first car 1 and the second car 2 are driven or where engines are arranged on both sides.

As can best be seen from FIG. 2 and FIG. 4, the bars 14 and 15 are arranged approximately at the same horizontal level as the beams 12, 13. The bars 14, 15 being connected to the beams 12, 13 are arranged approximately in the line of force of a horizontal force being transmitted along the beams 12, 13. This allows for horizontal forces being transmitted by the beams 12, 13 to be introduced into the beams 14, 15 directly horizontally. This provides the opportunity to leave out intermediate parts that would guide the horizontal forces transmitted by the bars 12, 13 into a different direction (vertical or slanted direction) first before introducing these forces into the connecting device and again diverting the forces from the vertical/slanted direction back into the horizontal direction by doing so.

FIG. 6 shows a gangway floor 100 for the gangway 4 between the first car 1 and the second car 2. The gangway floor comprises a first panel 101 that has the shape of a segment of a circle. The gangway floor 100 also includes a second panel 102 that has the shape of a segment of a circle. The circle of which the panel 101, 102 form segments of has a radius R. As can be seen from FIG. 7, the gangway floor is arranged between the floor 103 of the first car 1 and the floor 104 of the second car 2. As can also be seen from FIGS. 7 and 8, the radius R of the circle of which the floor panel 101 forms a segment of as well as the radius R of the circle of which the floor panel 102 forms a segment of is larger than 25% of the width W of the first car 1 and the second car 2. The radius R is larger than 45% of W and approximately about 48% of W. Arranged between the floor panel 101 and the floor panel 102 are four rectangular floor panels 105. The connection of the rectangular floor panels 105 to the panel 101 and the panel 102 is provided by means of a hinged connection 106. The hinged connection is obtained by the rectangular floor panels 105 having a tubular channel 107 (see FIG. 9). An axle is arranged between projecting parts 108 of the panel 101, 102. This axle will be arranged inside the tubular channel 107 in the rectangular plate 105 and will thereby allow the rectangular floor panel 105 to swivel relative to the first panel 101 and the second panel 102 about the axis of this axle. If a rubber tubular member is introduced into the tubular channel 107 and the axle is then introduced into the tubular rubber element, the rectangular floor panels will also be able to swivel about an axis perpendicular to the line of connection between the rectangular panels and the panels 101, 102.

As can be seen from FIG. 6, damping elements 109 can further be provided that allow for some relative movement between the panels 102, 101 and the rectangular panels 105. As can be seen in FIG. 6, these damping elements 109 can be arranged on the same side, while in the embodiment shown in FIG. 10 the damping elements 109 are intermittently arranged on one side or the other side of the rectangular panels 105.

The rectangular floor panels 105 are made from rubber reinforced by metal objects.

As can be seen from FIG. 6, the first floor panel 101 is arranged to rotate about a first axis F and the second floor panel 102 is arranged to rotate about a second axis G. The distance between the first axis and the second axis is 1.5 times the radius R of the circle of which the floor panel 101 and the floor panel 102 form a segment of.

The first panel 101 is set into a cut-out in a connector plate 110. The first plate 101 is horizontally supported by the connector plate 110. Likewise, the second panel 102 is set into the cut-out of a further connector plate 111 and is horizontally supported by this connector plate 111.

As can be seen from FIG. 7, the connector plates 110 and 111 are set into the floors 104 and 103 of the first car 1 and the second car 2. As can be seen from FIG. 8, the arrangement of the connector plates 110, 111 into the floors 103, 104 can be further enhanced by introducing spring-elements or damping elements 112 between the connector plates 110, 111 and the floors 103, 104.

FIG. 10 shows a further embodiment of the gangway floor. As can be seen, the first panel 113 and the second panel 114 are not designed as segments of a circle as has been shown in the embodiment of FIGS. 7-9. The first panel and the second panel is made up of two sectors of a circle, which are connected with a semi-circular element in the middle.

FIGS. 11, 12 and 13 show the assembly of parts for the connecting device for connecting the first car 1 with the second car 2 being arranged under the gangway floor 100.

The gangway floor is such arranged in relation to the assembly of parts that make up part of the connecting device that the respective vertical swivel axle D of the first group of elements 18 as shown in FIG. 5 is in line the axis G. Likewise, the axis F is in line with the vertical swivel axis D of the assembly of parts that form part of the right-hand connecting device.

The FIGS. 14-20 show parts of the gangway arranged between the first car 1 and the second car 2. The gangway has two panels 120, arranged facing each other (only one panel is shown in the FIGS. 14-20). Shown in FIG. 14 is furthermore a frame 121 to hold the panel 120. The frame 121 can be connected to the first car 1 and the second car 2 respectively and is arranged to introduce the weight of the panel 120 into the floor of the first car 1 and the second car 2. Between the frames 121 are arranged dampers 122 that allow for the frames 121 to take anti-parallel positions, for example when the multi-car vehicle is driving through a bend. By means of a joint 123 the panel 120 rests on the damper 122. This joint 123 acts as a pivot and allows the panel 120 to swivel about the axis H. The joint 123 is arranged in such a manner that the panel 120 can also swivel about the axis I-I. Thus, the panel 120 can swivel about two axis that are perpendicular arranged to one another and are also perpendicular to the longitudinal axis A of the beam 14. As can be seen from the FIGS. 14, 15 and 16, the joint is housed in a box 124. This box protects the joint 123, for example from passengers in the inside of the gangway. The joint 123 can be made as a spherolastic joint.

As can best be seen from FIG. 20, the panel has a central section 125 with an arch-shaped cross section in the horizontal plane. The plane 120 furthermore has two end sections 126 that in the same cross section are arch-shaped with a curvature opposite to the arch-shape of the central section. The curvature of the end section is smaller in radius than the curvature of the arch of the central section 125.

As can be seen from the FIGS. 21-24, the first car 1 has a sidewall 130 that bends inwards at the end of the first car 1. The radius R1 of the bend of the inwardly bent part equals half the width W of the first car 1.

As can be seen from FIG. 24, the end section of the panel 120 contacts the sidewall in a region inward of the inwardly bent end 130 of the sidewall of the first car 1 (inward towards the middle of the car 1 in the longitudinal direction of the car), when the first and the second car are aligned in a straight line. FIG. 24 also shows that the panel 120 can be covered with a further, rigid panel 131. This more rigid and square panel 131 can—for example—used for advertisement attached thereto.

FIG. 25 shows the multi-car vehicle in an operational state, when it drives around a bend. As can be seen in FIG. 25, the end section 126 of the panel 120 on the outside of the bend contacts the inwardly bent end 130 of the sidewall. For the panel 120 arranged on the inner side of the bend, the end sections still contact the sidewall itself. However, if the multi-car vehicle drives around an oppositely bend, the end sections 126 of this panel 120 will come into contact with the inwardly bent end 130 of the sidewalls of the cars.

The FIGS. 26 to 31 show a further embodiment of a gangway floor 300 for the gangway 4 between the first car 1 and the second car 2. The gangway floor comprises a first panel 301 that has the shape of the segment of a circle. The gangway floor 300 also includes a second panel 302 that has the shape of a segment of a circle. The circle of which the panel 301, 302 form segments of has a radius R. Arranged between the floor panel 301 and the floor panel 302 are six rectangular floor panels 305. A connection between the rectangular panels 305 and the first panel 301 and the second panel 302 allows the first panel 301 to swivel about a vertical axis relative to the second panel 302 and at the same time allows for the second panel 302 and the rectangular floor panels 305 to be tilted relative to the first floor panel 301 (to be positioned at an angle relative to the plane in which the first panel 301 lies. Or for the first panel 301 to be positioned in a plane that is offset parallel to the plane in which the second panel 302 lies is provided. This connection is provided by holding elements 306 that are provided with freely rotatable cylinders 307. The cylinders 307 support bars 308. Arranged on the support bars and orientated perpendicular to the longitudinal extent of the support bars 308 are panel supporting bars 309. A rectangular panel 305 is connected to one panel supporting bar 309 by means of screws 310. The support bar 308 has end limitation. parts 311 that are arranged such as to allow the supporting bar to travel a predetermined distance in its longitudinal direction, but for this distance to be limited by the end limitation parts 311 between the panel supporting bars 309 rubber elements 312. These rubber elements 312 pre-tension the panel supporting bars 309 into a predetermined position as shown in FIG. 27 for example. The rubber elements 312 allow, however, the panel supporting bars 309 to be pushed closer together. Furthermore, the rubber elements 312 dampen the movement of the panel supporting bars 309 and therefore act against rattle.

The rectangular panels 305 are supported in the vertical direction by the panel supporting bars 309 to which they are attached by screws. However, it is to be noted, that only one rectangular floor panel 305 is connected to a respective panel supporting bar 309. This allows the panel supporting bars 309 to move closer together to one another and thereby effecting one panel 305 to slide over a further panel 305 as indicated by the arrow F in FIG. 30. The movement of the panel supporting bars 309 relative to each other can be a parallel movement, with the panel supporting bars 309 keeping up their parallel arrangement as shown in the FIG. Such a movement will take place, if the panel 301 moves closer towards the panel 302 in a parallel manner. This allows for small rattle movements to be taken up. When driving around a bend, the one corner of the first panel 301 will move closer towards the opposite corner of the panel 302, while the other corner of the first panel 301 will move further away from its opposite corner of the second panel 302. In such a situation, the panel supporting bars will move closer to each other on the one side of the gangway floor 300, namely that side where the two corners of the first panel 301 and the second panel 302 are moving closer to each other, while the ends of the panel supporting bars 309 on the opposite side will be moving away from each other similar to the corners of the first panel 301 and second panel 302 arranged on that side of the gangway floor 300 moving away from each other. These movements are allowed for, because the panel supporting bars 309 are arranged to freely move on the support bars 308. The support bars 308 also vertically support the panel supporting bars 309, the support bars 308 themselves being vertically supported by the cylinders 307 and the holding elements 306 attached to the first panel 301 and the second panel 302.

If in a certain driving condition the first panel 301 is to tilt relative to the second panel 302 or if the second panel 302 is to take up a position in a plane that is offset in parallel to the plane in which the first panel 301 is arranged, the respective ends of the support bars 308 will be made to follow this movement due to these ends being held by the holding elements 306 to the respective panel. The support bar 308 will then, for example, be arranged at an angle to the horizontal plane. The rectangular floor panels 305 are made to follow this movement for the reason of the panel supporting bars 309 resting of the support bars 308 being made to follow the movement of the support bars 308.

FIG. 26 shows that the gangway floor 300 is covered by a cover 313. This cover 313 is preferably made from rubber. Being made from rubber, the cover 313 allows for the movements of the rectangular floor panels relative to each other and for example allows the rectangular floor panels to take up the angled position as described above for the case that the multi-car vehicle is driving around a bend. In such a driving condition, the cover 313 will be squeezed together in the region of the inner side of the curve, while it is made to spread on the outer side of the curve. Preferably, the cover 313 is selected to be made of such a rubber that it allows for spreading and squeezing for the amounts typical when driving around a bend that take place without the cover 313 to wrinkle. The cover 313 is made to lie on the rectangular floor panels 305 and to pretension the floor panels 305 into the predetermined position, namely the position shown in FIG. 27 with the rectangular floor panels 305 being arranged in parallel and being arranged with a predetermined space between the panel supporting bars 309. In doing so, the cover 313 can assist the gangway floor 300 to take up the predetermined position as shown in FIG. 26 whenever the multi-car vehicle returns to the straight line driving condition. The Fig. also show a side cover 314. This side cover can for example be used to attach side panels, for example like a side panel shown in the FIG. 14, 15, 16, 17, 18, 19, 20, 24, to the gangway floor 300 as shown in the FIGS. 26 to 31.

The FIG. 32, 33 show a different support structure for the rectangular floor panels of a gangway floor. The FIG. 32, 33 also show, that within the first panel 320 elements that form the shape of a segment of a circle can be provided. For example supporting parts 321 can be provided with the shape of a segment of a circle that support the first panel 320 or—as shown in FIG. 33—support the rubber cover 322 placed on top of the first panel 320.

The support structure for the rectangular floor panels (not shown) also contains support bars 323, similar to the support bars 308 as shown in the FIGS. 27 to 31. These support bars have a first type of connection or a second type of connection. The first type of connection consists of a rubber element 324 that is used to connect the first end of the support bar 323 to a holding element 325 that is attached to the first panel 320. The second type of connection consists of a pin 326 that is T-shaped at both ends. The pin is attached at its one end to the one end of the support bar 323. At its other end, the pin 326 is attached to a different holding element 327 that is attached to the first panel 320. As can be seen from FIG. 32, this second type of connection, similar to the first type of connection allows the supporting bar 323 to move relative to the first panel 320 within a limited way.

Figure 36:
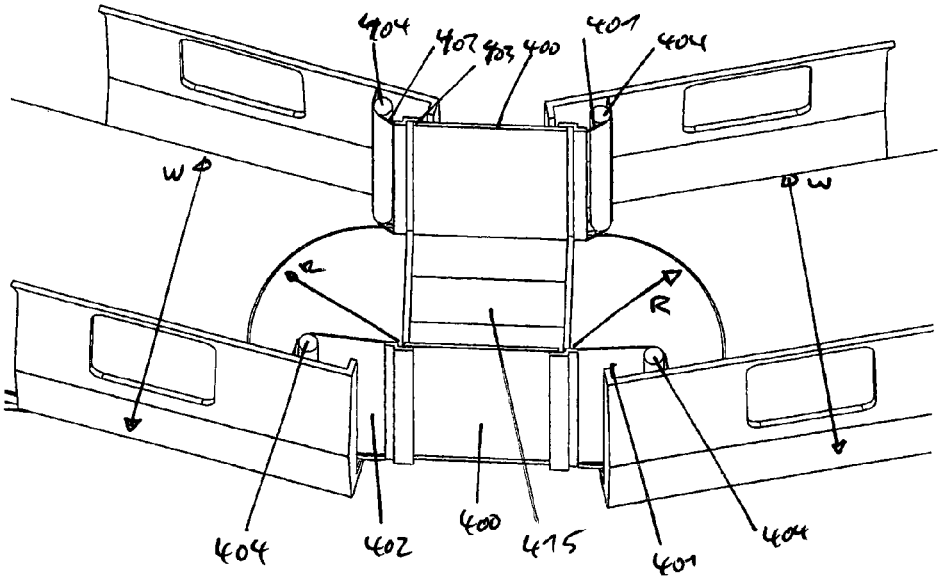
Figure 35:
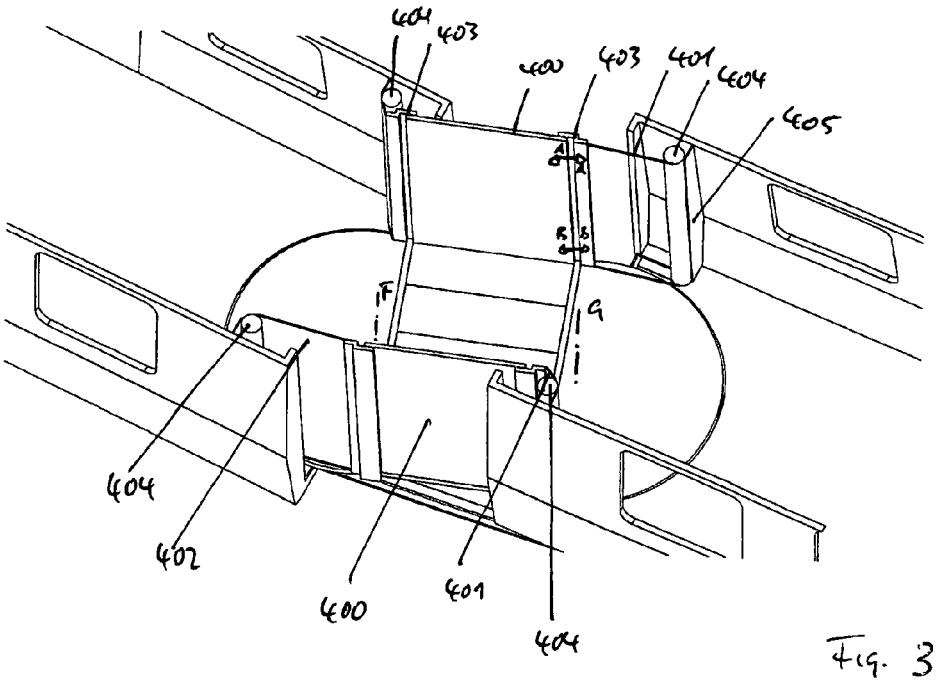

The embodiment shown in FIGS. 34 to 36 make use of a middle, rigid side panel 400 arranged on either side of the rigid middle side panel 400 is a side panel 401 and 402 according to the invention. The two side panels according to the invention (401, 402) and the middle rigid side panel 400 make up together the side wall of the gangway. The side panels 401, 402 are provided with second connections 403. This second connection connects the side panels 401, 402 respectively to the rigid middle side panel 400. This second connection 403 can be made to allow the rigid panel 400 to tilt relative to the side panels 401, 402. For example the second connection 403 can allow the top parts of the side panels 401, 402 to spread in the direction of the arrows A further apart from each other then the bottom of the side panels as indicated by the arrows B.

The side panels 401, 402 have first connections 404. These first connections have support elements in form of a cylinder and are designed similar to the design shown in the FIG. 37, 38, 39, 40, which allow the flexible section of the side panel to be wrapped around this cylinder. The first connection 404 is connected to the floor of the respective car. A deflecting element 405 is provided sideways to each first connection to prevent objects to be pulled along the side panel when it is being wrapped up around the cylinder.

A gangway floor 410 for the gangway comprises a first panel 411 that has the shape of a segment of a circle. The gangway floor 410 also includes a second panel 412 that has the shape of a segment of a circle. The circle of which the panel 411, 412 form segments of has a radius R. As can be seen, the gangway floor is arranged between the floor 413 of the first car and the floor 414 of the second car. The radius R of the circle of which the floor panel 411 forms a segment of as well as the radius R of the circle of which the floor panel 412 forms a segment of is larger than 25% of the width W of the first car and the second car. The radius R is larger than 45% of W and approximately about 48% of W. Arranged between the floor panel 411 and the floor panel 412 are rectangular floor panels 415. The connection of the rectangular floor panels 415 to the panel 411 and the panel 412 is provided by means of a hinged connection. The hinged connection is obtained by the rectangular floor panels 415 having a tubular channel. An axle is arranged between projecting parts of the panel 411, 412. This axle will be arranged inside the tubular channel in the rectangular plate 215 and will thereby allow the rectangular floor panel 415 to swivel relative to the first panel 411 and the second panel 412 about the axis of this axle. If a rubber tubular member is introduced into the tubular channel and the axle is then introduced into the tubular rubber element, the rectangular floor panels will also be able to swivel about an axis perpendicular to the line of connection between the rectangular panels and the panels 411, 412.

The rectangular floor panels 415 are made from rubber reinforced by metal objects.

As can be seen from FIG. 35, the first floor panel 411 is arranged to rotate about a first axis F and the second floor panel 412 is arranged to rotate about a second axis G. The distance between the first axis and the second axis is 1.5 times the radius R of the circle of which the floor panel 411 and the floor panel 412 form a segment of.

FIG. 37 shows the basic components that a gangway according to the invention can have in one embodiment, not showing further elements, like for example bellows that can be arranged around the gangway. The gangway 421 has two facing gangway side walls 422, a gangway ceiling 423 and a gangway floor 424. The gangway side wall 422 has a side panel 425. Also a first connection 426 is provided. The first connection 426 connects the side panel 425 to a frame structure 427 that is provided to connect the gangway to the respective car (not shown) on that side. Also a second connection 428 is provided. The second connection 428 connects the side panel 425 to a further frame structure 429 that is provided to connect the gangway to the car of the multi-car vehicle on the respective opposite end to the frame structure 427.

Deflector elements 430 are provided that prevent objects to move together with the side panel in the area of the deflector elements 430.

The gangway floor 424 has first rectangular panels 431 and second rectangular panels 432, whereby the second panel 432 can move relative to the first panel 431. The second panel 432 can move under the first panel 431. As shown in the driving condition of FIG. 37, which is a driving condition, whereby the multi-car vehicle would be driving around a bend, making it necessary for the right hand side panel 425 to be shortened relative to the left hand side panel 425, it can be seen that the first panel 431 and the second panel 432 can take up a relative position to one another, in which the longitudinal axis of the first panel 431 and the second panel 432 are at an angle relative to one another. In a different driving condition, where the multi-car vehicle would be going in a straight line, for example, the longitudinal axis of the first panel 431 and the longitudinal axis of the second panel 432 could be parallel.

FIG. 38 shows that in this embodiment the side panel 425 is connected to the first connection 426 at one side and connected to the second connection 428 at the second side that is opposite the first side. The first connection 6 is suitable to attach the side panel 425 to other parts of the gangway 421, namely to the frame structure 427. This is provided for by a fixing element 433 that is held stationary by its connection to the frame structure 427. As can be seen in FIG. 38, the side panel 425 at least in the section of its longitudinal extent in the region of the first connection 426 is flexible to be bend into the form of an arch, namely is flexible to be wrapped into a tube about the axis A of the arch, which is a vertical axis in the embodiment shown in the FIGS. 37 and 38.

In the embodiments shown in FIGS. 37 and 38 the first connection and the second connection are of similar design. In this embodiment, the side panel is arranged between the first connection and the second connection in a way that the side panel will be wrapped up at its respective ends along its longitudinal extent by the first connection and the second connection respectively.

In the embodiments shown in FIGS. 37 and 38, the side panel can be designed in such a manner that only the end sections along its longitudinal extent are flexible in order to allow these sections of the side panel to be wrapped up to form a tube at the first connection and the second connection. The middle section 434 can be made to be rigid. This allows for advertisement or monitors to be attached to this middle section of the side panel 425.

As can be best seen from the top view as shown in FIG. 38, wrapping the end sections of the side panel 425 into tubes allows for the side panel to be shortened along its longitudinal extent. In the FIG. 38, for example, the right hand side panel has been wrapped up more and therefore has a shorter longitudinal extent relative to the left hand side panel 425. This allows the gangway to remain firmly attached to the cars by means of the frame structures 427 and 429 while at the same time allowing the cars to take up a position, where the longitudinal axis of the cars are not in line anymore, but angled to one another, for example when the multi-car vehicle is driving around a bend.

FIG. 39 shows the design of a first connection as could for example be used in the design shown in the FIGS. 37 and 38, where the flexible section of the side panel is made to wrap up into a tube. The design shown in FIG. 39 has a fixed axle 443 that is connected to a fixing element 433 that connects the fixed axle 443 to the frame structure 427. A support element 435 in the form of a cylinder is provided. The flexible section of the side panel 425 (not shown) can be made to wrap up around the cylinder to be bend into the form of an arch, namely to be wrapped up into the form of a tube.

In the embodiment shown in FIG. 39, a torsional spring 444 is provided that is connected to the support element 435 at one end and the fixed axle 443 at the other end, thereby pre-tensioning the support element 435 into one rotational direction. A bearing 445 is provided that supports the support element 435 on the fixed axle and allows the support element 435 to rotate about the axis of the first arch, but also allows the support element 435 to pivot in the direction of the arrow C-C. Allowing for this rotation in direction of the arrow C-C, namely about a vertical axis allows for driving conditions, where the gangway ceiling is, for example spread further apart then the gangway floor, for example when the train is running over the top of a hill.

What is claimed is:

1. A gangway to be arranged between a first car of a multi-car vehicle and a second car of said vehicle, the gangway comprising:

a gangway floor having a first floor panel and a second floor panel, wherein the first floor panel is arranged to rotate about a first axis that does not lie in the plane that the first floor panel lies in, and the second floor panel is arranged to rotate about a second axis that does not lie in the plane that the second floor panel lies in, wherein the first axis is different from the second axis; and a panel that is connected to the gangway floor by means of a joint that allows swivel movements about two axes that are perpendicularly arranged to one another.

2. The gangway according to claim 1, wherein the first floor panel is arranged inside a cut-out provided in a neighbouring floor panel next the first floor panel and arranged to rotate about the first axis inside the cut-out relative to the neighbouring floor panel, wherein the first floor panel and/or the cut-out has the shape of a sector of a circle or the shape of a segment of a circle or the shape of the segment of a ring.

3. The gangway according to claim 1, wherein the first floor panel is connected to the second floor panel by at least a third panel.

4. The gangway according to claim 3, wherein the third panel is flexibly connected to the first panel to allow linear and/or rotational movements of the third panel relative to the first panel.

5. The gangway according claim 3, wherein the third panel has a rectangular shape.

6. The gangway according to claim 5, wherein a multitude of rectangular floor panels are provided in parallel to one another each rectangular floor panel being attached both to the first floor panel and the second floor panel.

7. The gangway according to claim 1, wherein at least one of the panels of the gangway floor is made from rubber, or rubber reinforced by metal objects and/or reinforced by textile fabric.

8. The gangway according to claim 1, wherein at least one of the panels of the gangway floor is made from an elastic material other than rubber, or is made from metal.

9. The gangway according to claim 1, wherein the panel has a central section with an arch-shaped cross section in the horizontal plane and the panel has end sections that in the same cross section are arch-shaped with a curvature opposite to the arch-shape of the central section.

10. The gangway according to claim 1, wherein the first car has a side-wall and wherein the side-wall bends inwards at the end of the first car, wherein an end section of the panel of the gangway contacts the side-wall in a region inward of the inwardly bent end of the side-wall inward towards a middle of the car in the longitudinal direction of the car when the first and the second car are aligned in a straight line, and wherein the end section of the panel contacts the inwardly bent end of the side-wall in at least one operational mode of the multi-car vehicle in which the first car and the second car are not aligned in a straight line, but arranged at an angle to one another.

11. A multi-car vehicle comprising:

a first car and a second car;

a gangway arranged between the first car and the second car and having a gangway floor having a first floor panel and a second floor panel, wherein the first floor panel is arranged to rotate about a first axis that does not lie in the plane that the first floor panel lies in, and the second floor panel is arranged to rotate about a second axis that does not lie in the plane that the second floor panel lies in, wherein the first axis is different from the second axis; and a panel that is connected to the gangway floor by means of a joint that allows swivel movements about at least one axis, wherein the first car is connected to the second car by a connection device and wherein the gangway floor is at least partially supported in the vertical direction by a support device arranged between a part of the connection device and a part of the gangway floor, wherein the first car has a side-wall and wherein the side-wall bends inwards at the end of the first car, wherein an end section of the panel of the gangway contacts the side-wall in a region inward of the inwardly bent end of the side-wall inward towards a middle of the car in the longitudinal direction of the car when the first and the second car are aligned in a straight line, and wherein the end section of the panel contacts the inwardly bent end of the side-wall in at least one operational mode of the multi-car vehicle in which the first car and the second car are not aligned in a straight line, but arranged at an angle to one another.

12. The multi car vehicle according to claim 11, wherein the panel that is connected to the gangway floor by means of a joint allows swivel movements about two axes that are perpendicularly arranged to one another.

13. The multi-car vehicle according to claim 11, wherein the connection device has at least three parts, a first part of the at least three parts configured to rotate relative to a second part of the three parts about the first axis, and wherein the second part of the three parts is configured to rotate relative to a third part of the three parts about the second axis.

14. The multi-car vehicle according to claim 11, wherein a radius of the inwardly bent end of the first car equals half the width of the first car.

15. The multi-car vehicle according to claim 11, wherein a surface of the side-wall that is contacted by the end section of the panel is adapted to allow sliding between the end section and the panel with reduced friction.

16. The multi-car vehicle according to claim 11, wherein the first floor panel is arranged inside a cut-out provided in a neighbouring floor panel next to the first floor panel and arranged to rotate about the first axis inside the cut-out relative to the neighbouring floor panel, wherein the first floor panel and/or the cut-out has the shape of a sector of a circle or the shape of a segment of a circle or the shape of the segment of a ring.

17. The multi-car vehicle according to claim 11, wherein the first floor panel is connected to the second floor panel by at least a third panel.

18. The multi-car vehicle according to claim 17, wherein the third panel is flexibly connected to the first panel to allow linear and/or rotational movements of the third panel relative to the first panel.

19. The multi-car vehicle according to claim 17, wherein the third panel has a rectangular shape.

20. The multi-car vehicle according to claim 19, wherein a multitude of rectangular floor panels are provided in parallel to one another, each rectangular floor panel being attached both to the first floor panel and the second floor panel.

* * * * *